US012006824B2

(12) United States Patent
Niederriter et al.

(10) Patent No.: US 12,006,824 B2
(45) Date of Patent: Jun. 11, 2024

(54) CUTTING ASSEMBLY FOR LONGWALL MINING SYSTEM

(71) Applicant: Joy Global Underground Mining LLC, Warrendale, PA (US)

(72) Inventors: Edward Niederriter, Fryburg, PA (US); Ian Ruscak, Franklin, PA (US); Troy Amsler, Shippenville, PA (US)

(73) Assignee: JOY GLOBAL UNDERGROUND MINING LLC, Warrendale, PA (US)

( * ) Notice: Subject to any disclaimer, the term of this patent is extended or adjusted under 35 U.S.C. 154(b) by 0 days.

(21) Appl. No.: 17/526,382

(22) Filed: Nov. 15, 2021

(65) Prior Publication Data

US 2022/0154575 A1 May 19, 2022

Related U.S. Application Data

(60) Provisional application No. 63/114,235, filed on Nov. 16, 2020.

(51) Int. Cl.
*E21C 25/10* (2006.01)
*E21C 41/18* (2006.01)

(52) U.S. Cl.
CPC ..... *E21C 25/10* (2013.01); *E21C 41/18* (2013.01)

(58) Field of Classification Search
CPC ..... E21C 25/00–31/12
See application file for complete search history.

(56) References Cited

U.S. PATENT DOCUMENTS 2,721,733 A 10/1955 Driehaus
3,219,389 A 11/1965 Willy
3,290,096 A 12/1966 Stalker
3,424,499 A 1/1969 Webster
3,954,299 A 5/1976 Hartley
4,027,918 A * 6/1977 Hujimori ..... E21C 27/02 299/71
4,047,763 A 9/1977 Gilliland et al.
4,172,616 A 10/1979 Delli-gatti, Jr.
4,303,277 A 12/1981 Roepke et al.
4,317,594 A 3/1982 Unger
4,328,996 A 5/1982 Jahn
(Continued)

FOREIGN PATENT DOCUMENTS

CN 202381091 U 8/2012
CN 106223946 A 12/2016
(Continued)

OTHER PUBLICATIONS

International Search Report and Written Opinion for Application No. PCT/US2021/059355 dated Feb. 11, 2022 (21 pages).

*Primary Examiner* — Janine M Kreck
(74) *Attorney, Agent, or Firm* — Husch Blackwell LLP

(57) ABSTRACT

A cutting assembly for a mining machine includes a mount configured to move about a first axis relative to a chassis of the mining machine and a ranging arm coupled to the mount. The ranging arm is moveable relative to the mount. The cutting assembly includes a cutting head having a housing coupled to the ranging arm. The housing is moveable relative to the ranging arm. The cutting head includes a drum supported for rotation relative to the housing about a rotational axis, a plurality of cutting bits coupled to the drum, and at least one motor supported by the housing to drive the drum about the rotational axis.

19 Claims, 25 Drawing Sheets

(56) References Cited

U.S. PATENT DOCUMENTS

| | | | | |
|---|---|---|---|---|
| 4,589,701 | A * | 5/1986 | Beckmann | E21C 35/00 299/72 |
| 6,158,818 | A | 12/2000 | Schaeff et al. | |
| 6,315,365 | B1 | 11/2001 | Gerer et al. | |
| 6,626,500 | B1 | 9/2003 | Cribb et al. | |
| 7,909,275 | B2 | 3/2011 | Gross et al. | |
| 8,608,250 | B2 | 12/2013 | O'Neill | |
| 9,068,453 | B2 | 6/2015 | Rohwer et al. | |
| 9,920,624 | B2 | 3/2018 | Doheny, II et al. | |
| 10,036,248 | B2 | 7/2018 | Defibaugh et al. | |
| 10,214,360 | B1 | 2/2019 | Rimmington | |
| RE47,498 | E | 7/2019 | Niederriter et al. | |
| 2011/0156470 | A1 | 6/2011 | Zimmerman et al. | |
| 2014/0265528 | A1 | 9/2014 | O'Neill | |
| 2015/0204190 | A1 | 7/2015 | Krings et al. | |
| 2018/0171796 | A1 | 6/2018 | Moberg et al. | |
| 2018/0298753 | A1 | 10/2018 | Moberg et al. | |
| 2020/0032824 | A1 | 1/2020 | Niederriter et al. | |
| 2020/0400019 | A1 * | 12/2020 | Quast | E21C 31/02 |

FOREIGN PATENT DOCUMENTS

| | | | | |
|---|---|---|---|---|
| CN | 107654229 | A | 2/2018 | |
| GB | 2074216 | A * | 10/1981 | E21C 27/02 |

* cited by examiner

CUTTING ASSEMBLY FOR LONGWALL MINING SYSTEM

CROSS-REFERENCE TO RELATED APPLICATION

This application claims the benefit of U.S. Provisional Patent Application No. 63/114,235 filed Nov. 16, 2020, the contents of which are incorporated herein by reference.

TECHNICAL FIELD

The present disclosure relates to longwall mining systems, and particularly to cutting assemblies for a longwall mining system.

SUMMARY

Mining systems, such as longwall mining systems, include one or more ranging arms having cutting drums for cutting material from a mine face. In some embodiments, the material is deposited on an armored face conveyor (AFC) and carried away from the mine face.

In one aspect, a cutting assembly for a mining machine includes a mount configured to move about a first axis relative to a chassis of the mining machine and a ranging arm coupled to the mount. The ranging arm is moveable relative to the mount. The cutting assembly includes a cutting head having a housing coupled to the ranging arm. The housing is moveable relative to the ranging arm. The cutting head includes a drum supported for rotation relative to the housing about a rotational axis, a plurality of cutting bits coupled to the drum, and at least one motor supported by the housing to drive the drum about the rotational axis.

In another aspect, a cutting assembly for a mining machine includes a mount configured to move about a first axis relative to a chassis of the mining machine and a cutting head having a housing, a drum rotatably coupled to the housing about a rotational axis, a plurality of cutting bits coupled to the drum, and at least one motor supported by the housing to drive the drum about the rotational axis. The cutting assembly includes a ranging arm coupled to the mount and supporting the cutting head for movement about the first axis.

In yet another aspect, a cutting assembly for a mining machine includes a ranging arm configured to be coupled to a chassis of the mining machine and a cutting head having a housing coupled to the ranging arm, a drum rotatably coupled to the housing about a rotational axis, a plurality of cutting bits coupled to the drum, and at least one motor supported by the housing to drive the drum about the rotational axis. The cutting assembly is configured to include at least four degrees of movement of the drum relative to the chassis.

Other aspects will become apparent by consideration of the detailed description and accompanying drawings.

DETAILED DESCRIPTION

Before any embodiments are explained in detail, it is to be understood that the disclosure is not limited in its application to the details of construction and the arrangement of components set forth in the following description or illustrated in the following drawings. The disclosure is capable of supporting other embodiments and being practiced or being carried out in various ways. Also, it is to be understood that the phraseology and terminology used herein is for the purpose of description and should not be regarded as limiting. Use of "including" and "comprising" and variations thereof as used herein is meant to encompass the items listed thereafter and equivalents thereof as well as additional items. Use of "consisting of" and variations thereof as used herein is meant to encompass only the items listed thereafter and equivalents thereof. Unless specified or limited otherwise, the terms "mounted," "connected," "supported," and "coupled" and variations thereof are used broadly and encompass both direct and indirect mountings, connections, supports, and couplings. Terms of degree, such as "substantially," "about," "approximately," etc. are understood by those of ordinary skill to refer to reasonable ranges outside of the given value, for example, general tolerances associated with manufacturing, assembly, and use of the described embodiments.

Figure 1:
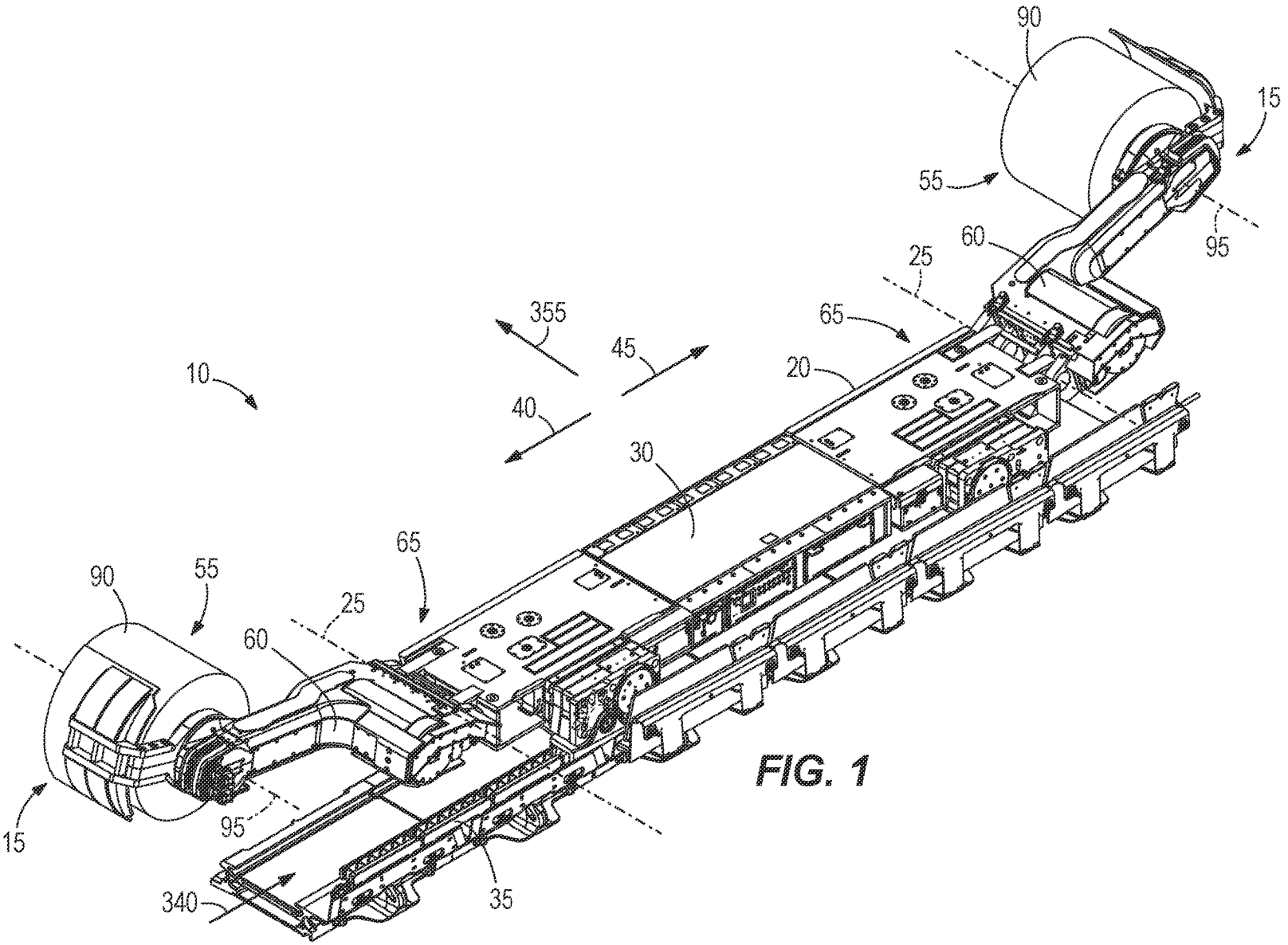
FIG. 1 is a perspective view of a mining machine including cutting assemblies.

FIG. 1 illustrates a mining machine, such as a longwall shearer 10, including a pair of cutting assemblies 15 each pivotably coupled to a frame or chassis 20 about a first axis 25. The chassis 20 includes a power unit 30 (e.g., electrical power unit, hydraulic power unit, combination of electrical and hydraulic power unit, etc.) operable to move or tram the shearer 10 along a track 35 in a first direction 40 or a second direction 45 opposite the first direction 40.

Figure 2:
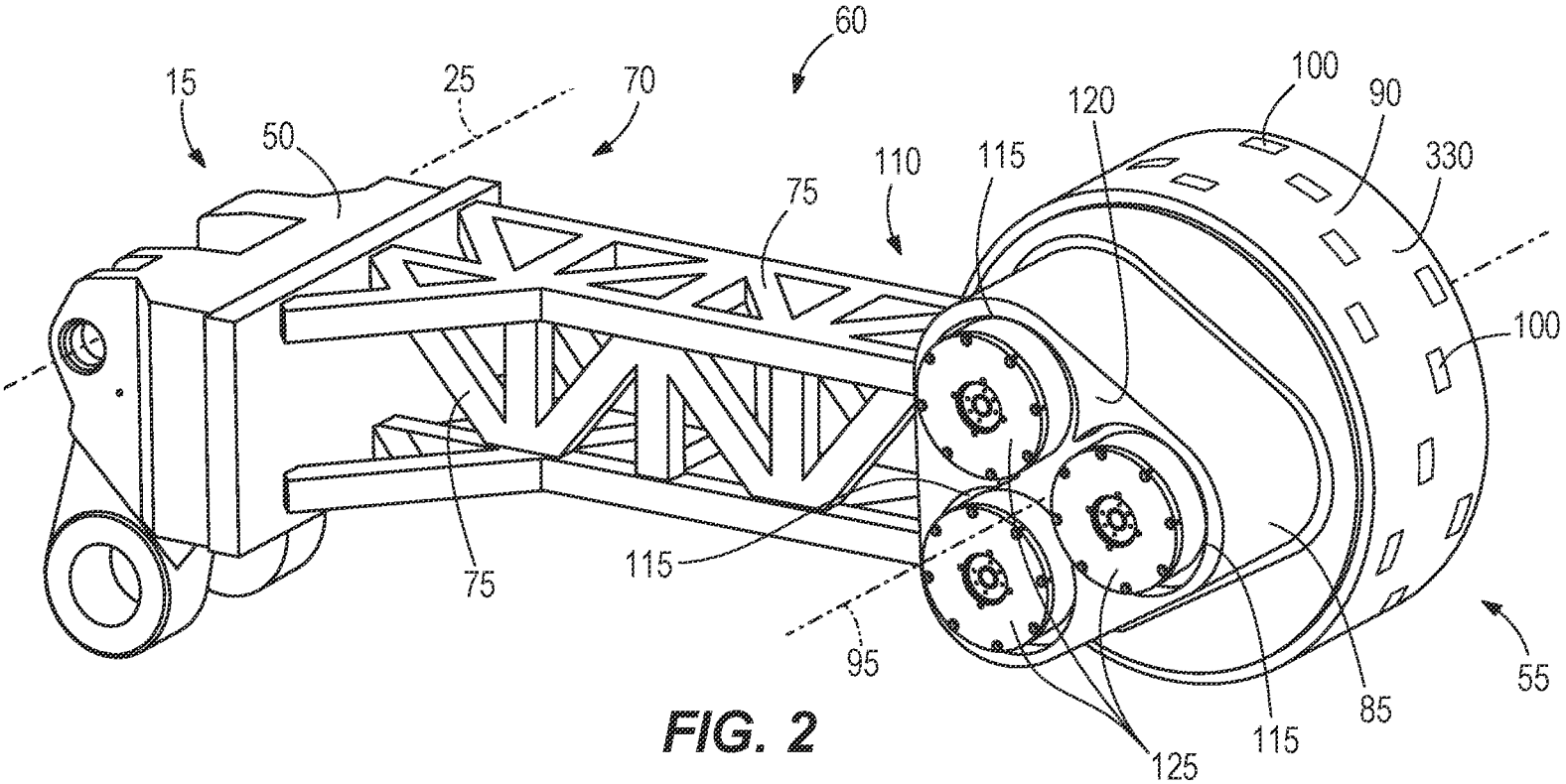
FIG. 2 is a perspective view of a cutting assembly according to one embodiment.

FIG. 2 illustrates one cutting assembly 15 that includes substantially the same components as the other cutting assembly 15. As such, only the first cutting assembly 15 will be described in detail, but the components and features of the first cutting assembly 15 are equally applicable to the second cutting assembly 15. The illustrated cutting assembly 15 includes a chassis mount 50, a drum and motor assembly 55 (e.g., a cutting head), and a support structure 60 (e.g., a ranging arm) coupling the drum and motor assembly 55 to the chassis mount 50. The chassis mount 50 is pivotably coupled to the chassis (e.g., at an end portion 65) about the first axis 25. A hydraulic actuator (not shown), which is powered by the power unit 30, is coupled to the chassis 20 and the chassis mount 50 and operable to pivot the cutting assembly 15 about the first axis 25.

With continued reference to FIG. 2, the chassis mount 50 is fixed to an inboard end 70 of the support structure 60. The illustrated support structure 60 includes a plurality of structural members 75. In some embodiments, the structural members 75 can be hollow cuboid tubes coupled together (e.g., by a welding process, etc.) to provide an engineered support structure (support arm) that supports the weight of the drum and motor assembly 55 in a cantilevered manner relative to the chassis mount 50. In other embodiments, the structural members 75 can be hollow cylindrical tubes, solid cuboid members, solid cylindrical members, etc.

Figure 3:
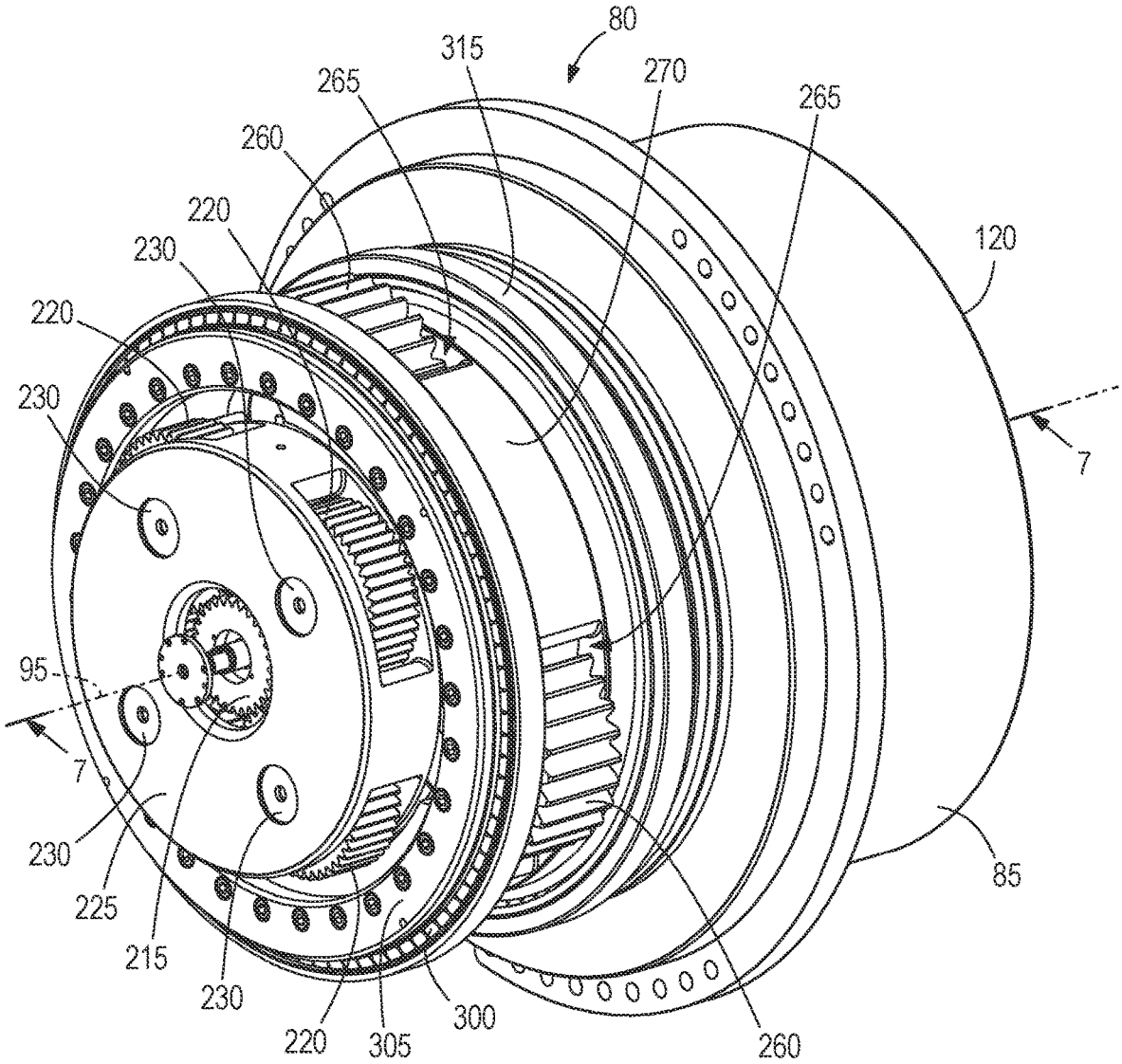
FIG. 3 is a perspective view of a powertrain that drives a cutting drum of the cutting assembly of FIG. 2.
Figure 4:
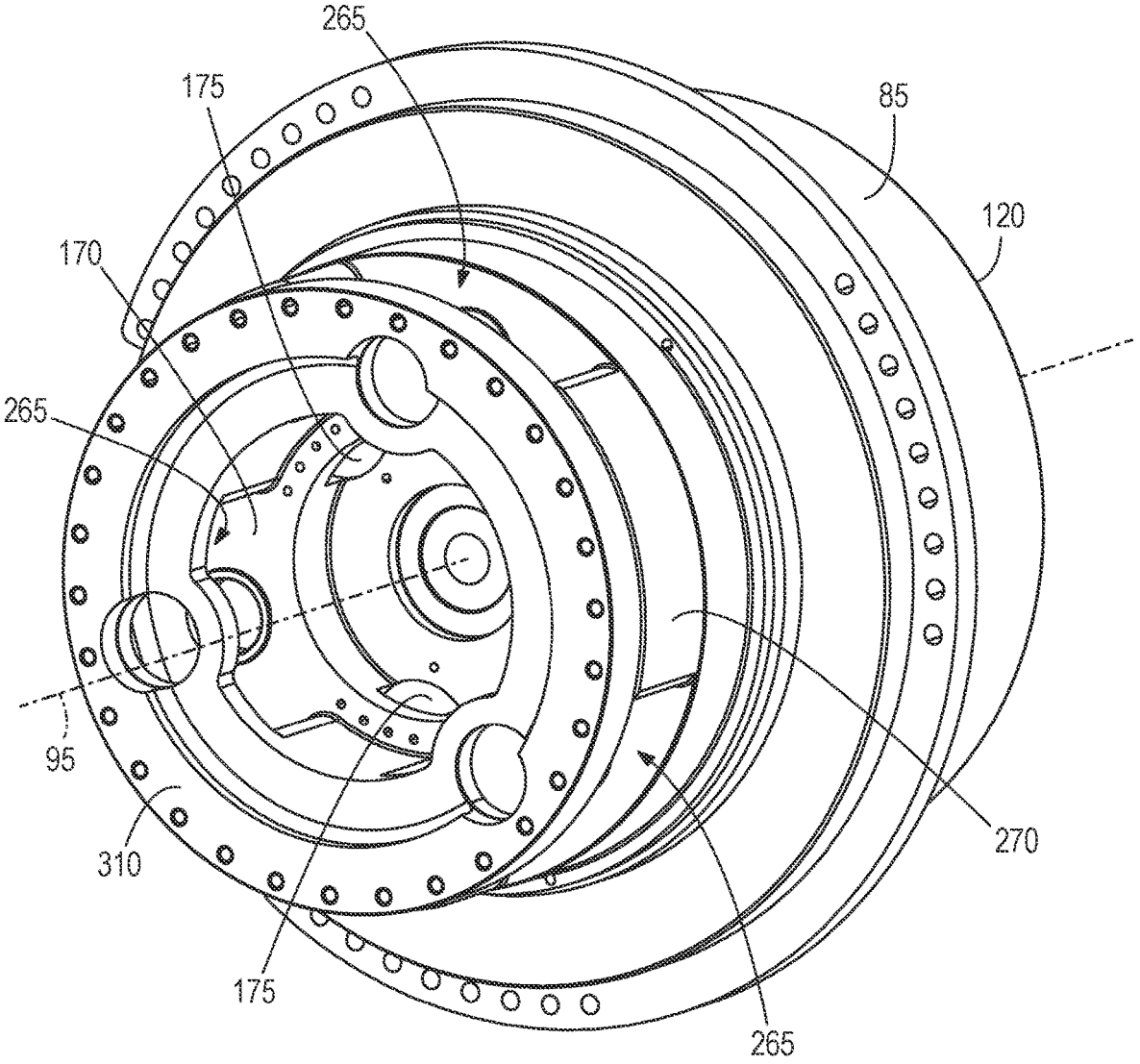
FIG. 4 is a perspective view of a housing of the powertrain of FIG. 3.

As shown in FIGS. 2 and 3, the drum and motor assembly 55 includes a powertrain 80 supported by a housing 85 and operable to drive a drum 90 about a rotational axis 95. The drum 90 includes a plurality of cutting bit assemblies 100. The illustrated housing 85 is coupled to an outboard end 110 of the support structure 60 opposite the inboard end 70. The housing 85 includes a plurality of cavities 115 formed in a rear side 120 of the housing 85. The cavities 115 support a plurality of motors 125 (e.g., electric motors, hydraulic motors, etc.). In the illustrated embodiment, the powertrain 80 includes three electric motors 125 each positioned within one cavity 115. In other embodiments, the powertrain 80 can include one motor 125, two motors 125, or more than three motors 125. The illustrated motors 125 are in communication with the power unit 30 of the chassis 20 for the power unit 30 to drive the motors 125. Accordingly, the illustrated support structure 60 supports power lines (e.g., electrical power lines, hydraulic power lines, etc.) that couple the motors 125 to the power unit 30. The support structure 60 also supports lubricant lines to supply the powertrain 80 with lubricant (e.g., oil). The support structure 60, however, does not provide a housing to support any component of the powertrain 80. Rather, the powertrain 80 is supported by the housing 85.

Figure 5:
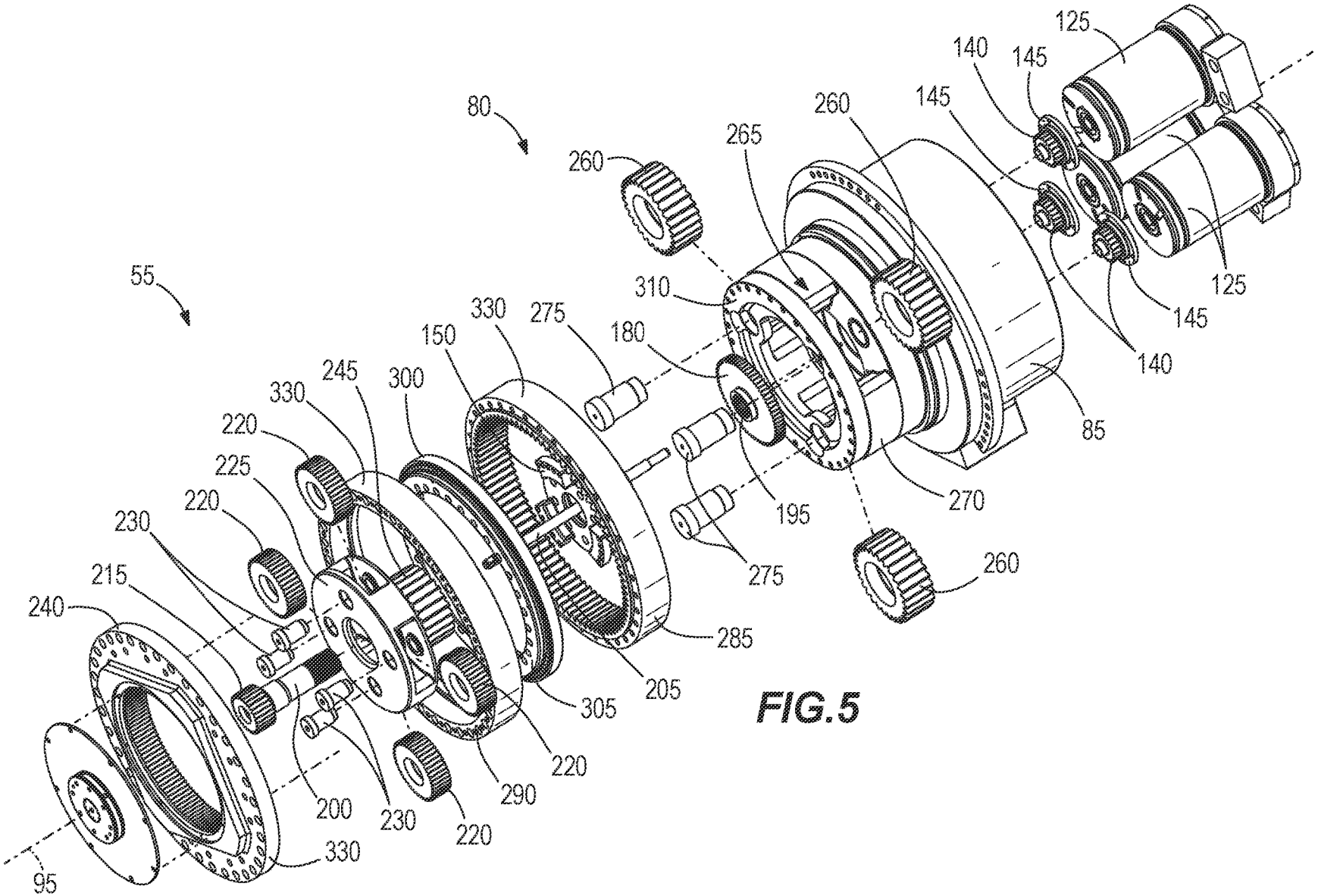
FIG. 5 is a first exploded view of the powertrain of FIG. 3.
Figure 6:
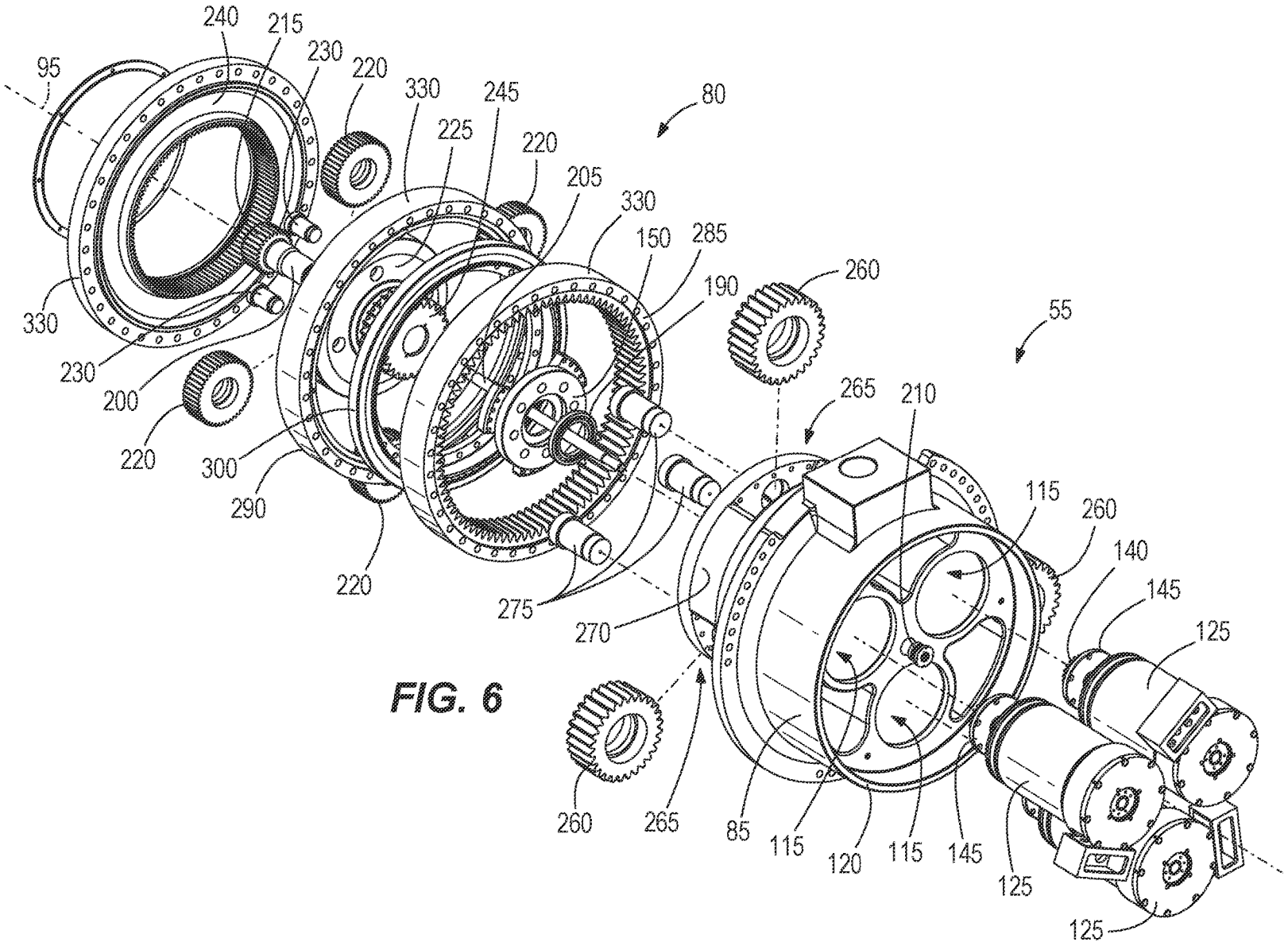
FIG. 6 is a second exploded view of the powertrain of FIG. 3.
Figure 7:
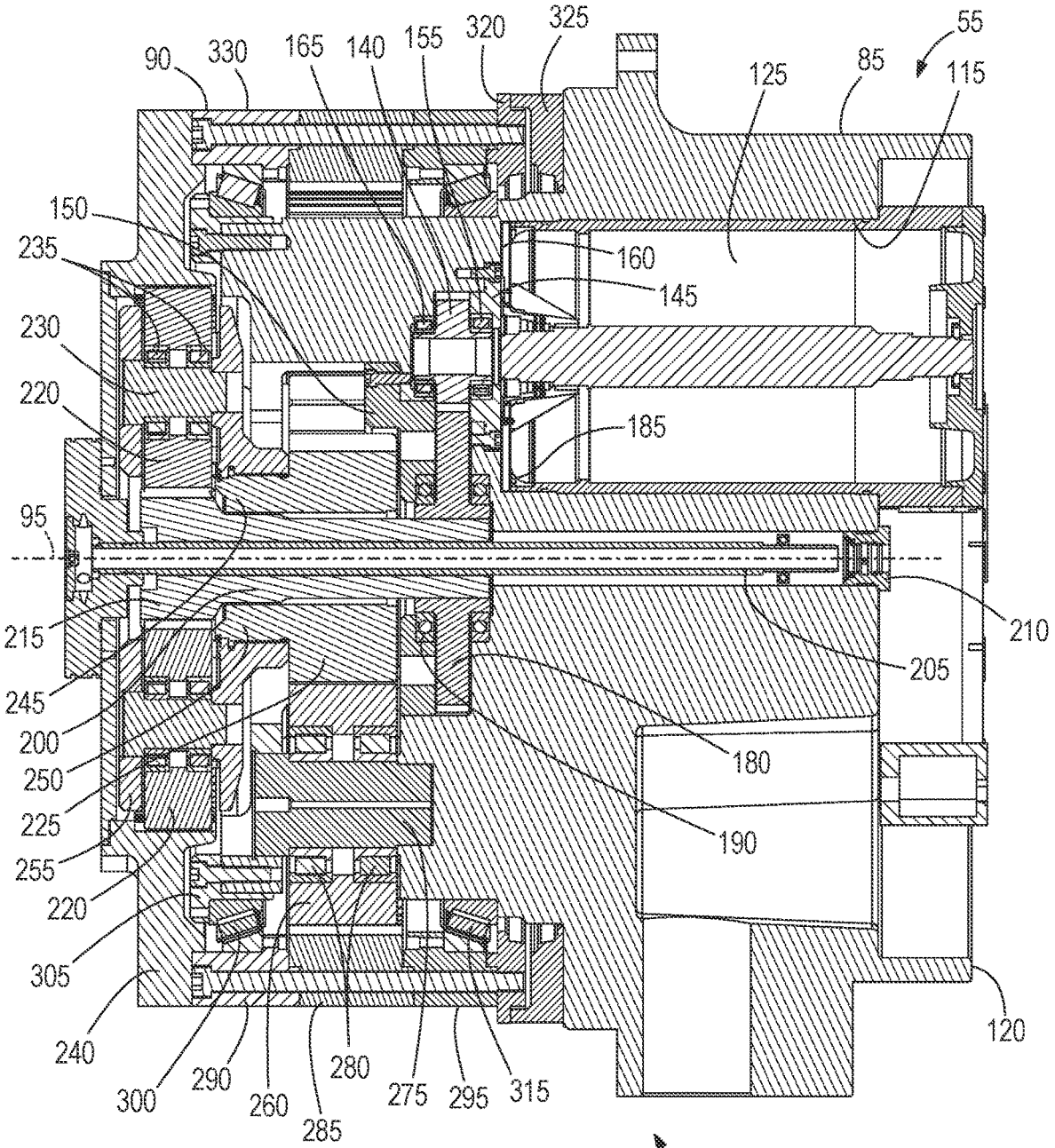
FIG. 7 is a cross sectional view of the powertrain taken along line 7-7 of FIG. 3.

With reference to FIGS. 4-7, each motor 125 is coupled to an output pinion 140 that is rotatably coupled between a pinion bearing retainer 145, the housing 85, and a central bearing retainer 150. In particular, a first pinion roller bearing 155 is seated within each pinion bearing retainer 145 to rotatably support a first side of the corresponding output pinion 140 (FIG. 7). Each pinion bearing retainer 145 is fixed to a rear surface 160 of the housing 85. A second pinion roller bearing 165 is coupled between the housing 85 and the central bearing retainer 150 to rotatably support a second side of the corresponding output pinion 140 (FIG. 7). The central bearing retainer 150 is fixed to an inner surface 170 (FIG. 4) of the housing 85. The output pinions 140 are positioned relative to the housing 85 such that a portion of each output pinion 140 extends through a corresponding aperture 175 (FIG. 4) formed in the housing 85 to engage a sun gear 180.

As shown in FIGS. 5-7, the sun gear 180 is rotatably coupled between the housing 85 and the central bearing retainer 150 in a direction along the rotational axis 95. In particular, a first sun gear roller bearing 185 is seated within the housing 85 to rotatably support a first side of the sun gear 180. A second sun gear roller bearing 190 is seated within the central bearing retainer 150 to rotatably support a second side of the sun gear 180. The sun gear 180 includes a central aperture 195 (FIG. 5) that receives a drive shaft 200. The drive shaft 200 is engaged with the sun gear 180 to be driven about the rotational axis 95. As shown in FIG. 7, a lubricant conduit 205 extends through the drive shaft 200 and is operable to dispense lubricant (e.g., oil, etc.) throughout the powertrain 80. The lubricant enters through an inlet 210 formed in the housing 85.

The drive shaft 200 includes a shaft gear 215 engaged with a plurality of first stage planetary gears 220. In the illustrated embodiment, the plurality of first stage planetary gears 220 includes four first stage planetary gears 220. In other embodiments, the plurality of first stage planetary gears 220 can include fewer or more than four first stage planetary gears 220. The illustrated first stage planetary gears 220 are rotatably coupled to a carrier 225. In particular, each first stage planetary gear 220 is coupled to the carrier 225 by a first pin 230 and first planetary roller bearings 235 (FIG. 7) positioned between the first stage planetary gear 220 and the first pin 230. The first pins 230 are fixed to the carrier 225. In other embodiments, each first stage planetary gear 220 can be fixed relative to the corresponding first pin 230 and the first pins 230 can be rotatably coupled to the carrier 225 by the first planetary roller bearings 235. The first stage planetary gears 220 are also engaged with a first ring gear 240 such that the first stage planetary gears 220 are supported between the shaft gear 215 and the first ring gear 240.

The illustrated carrier 225 is coupled to a compound gear 245 that is positioned around the drive shaft 200 without engaging the drive shaft 200 (FIG. 7). The illustrated compound gear 245 includes a first portion 250 that is received within the carrier 225 to be engaged therewith. The compound gear 245 also includes a second portion 255 having a greater outer diameter than the first portion 250. The second portion 255 is engaged with a plurality of second stage planetary gears 260. The second stage planetary gears 260 include a greater outer diameter than the first stage planetary gears 220. In the illustrated embodiment, the plurality of second stage planetary gears 260 includes three second stage planetary gears 260. In other embodiments, the plurality of second stage planetary gears 260 can include fewer or more than three second stage planetary gears 260. The illustrated second stage planetary gears 260 are rotatably supported within slots 265 formed in an outer surface 270 of the housing 85. In particular, each second stage planetary gear 260 is rotatably coupled to the housing 85 by a second pin 275 and second planetary roller bearings 280 positioned between the second stage planetary gear 260 and the second pin 275. The second pins 275 are fixed to the housing 85. In other embodiments, each second stage planetary gear 260 can be fixed relative to the corresponding second pin 275 and the second pins 275 can be rotatably coupled to the housing 85 by the second planetary roller bearings 280. The second stage planetary gears 260 engage a second ring gear 285.

With reference to FIG. 7, the first ring gear 240 and the second ring gear 285 are fixed to a first ring spacer 290 and a second ring spacer 295 to form the drum 90. The first ring spacer 290 and the second ring spacer 295 rotatably support the drum 90 relative to the housing 85. In particular, a first drum roller bearing 300 is positioned between the first ring spacer 290, the housing 85, and a drum bearing retainer 305. The drum bearing retainer 305 is fixed to a front surface 310 (FIG. 4) of the housing 85. A second drum roller bearing 315 is positioned between the second ring spacer 295 and the housing 85. With continued reference to FIG. 7, an end ring 320 is fixed to the second ring spacer 295 to interface with a seal ring 325. The seal ring 325 is fixed to the housing 85 and inhibits dirt and debris from entering between the drum 90 and the housing 85. In some embodiments, outer surfaces 330 of the first ring gear 240, the second ring gear 285, the first ring spacer 290, and the second ring spacer 295 provide a surface to which the plurality of cutting bit assemblies 100 are coupled.

Figure 8:
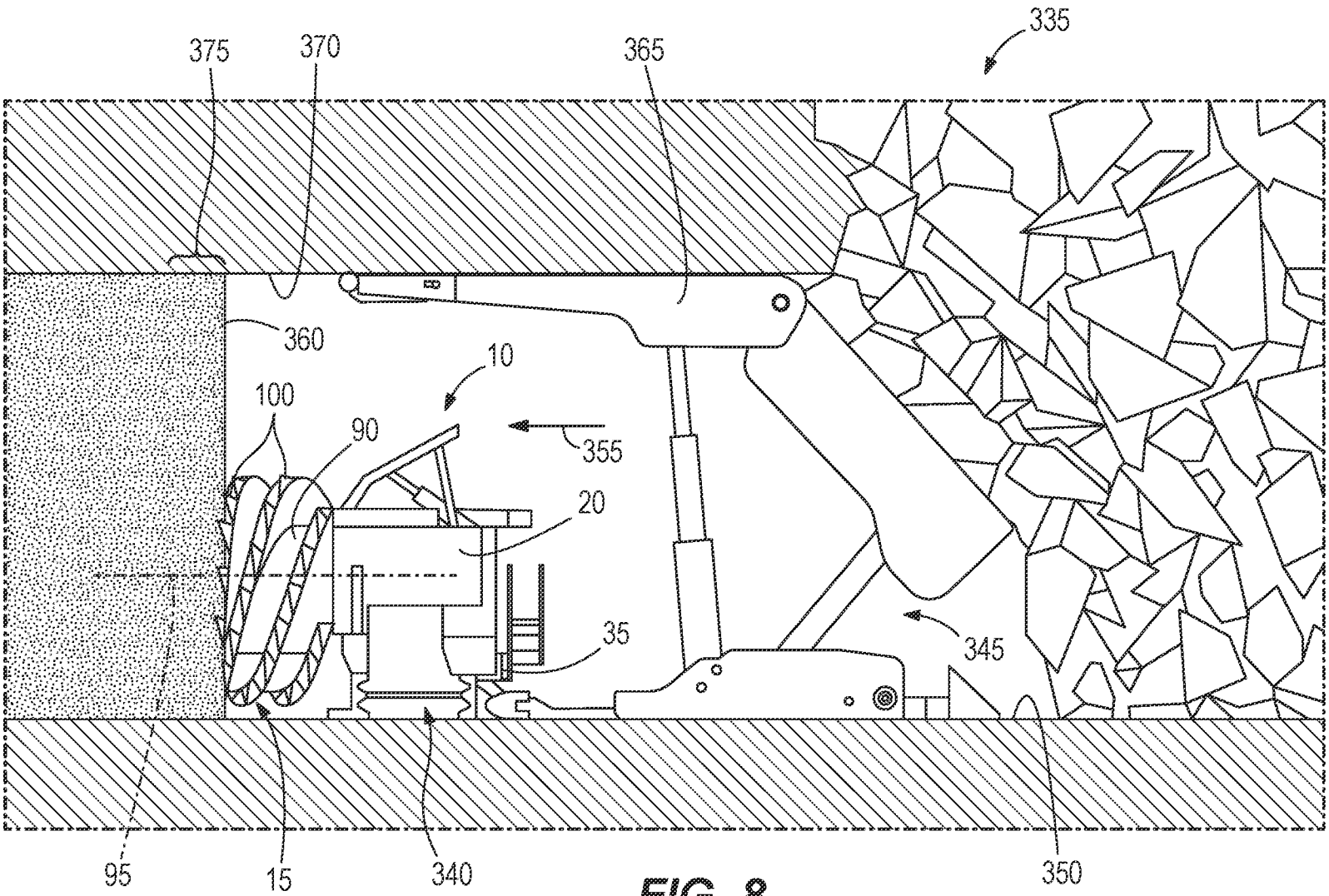
FIG. 8 illustrates a side view of the mining machine of FIG. 1 during operation.

As shown in FIG. 8, a portion of a longwall mining system 335 is illustrated including the shearer 10, a conveyor assembly 340, and roof supports 345 that are supported on a mine floor 350. The illustrated roof supports 345 are operable to advance the shearer 10 and the conveyor assembly 340 in a forward direction 355 toward a mine face 360. In the illustrated embodiment, the forward direction 355 is perpendicular to the first tramming direction 40 and the second tramming direction 45 of the shearer 10. Each roof support 345 is positioned behind the conveyor assembly 340 (i.e., away from the mine face 360) and includes a shield 365 extending over the chassis 20 and the conveyor assembly 340 to engage a mine roof 370 opposite the mine floor 350.

In operation, the first and second cutting assemblies 15 are moved about the first axis 25 to position the drums 90 of each assembly 15 relative to the mine face 360. For example, the first cutting assembly 15 can be elevated to cut material (e.g., coal or other minerals) from an upper portion of the mine face 360 adjacent the roof 370, while the second cutting assembly 15 can be lowered to cut material from a lower portion of the mine face 360 adjacent the floor 350. Referring again to FIGS. 1 and 7, the power unit 30 on the chassis 20 provides power to the motors 125 that rotate in unison to drive the corresponding output pinion 140. In turn, the output pinions 140 drive the sun gear 180 to rotate the drive shaft 200 about the rotational axis 95. The drive shaft 200 then drives the first stage planetary gears 220 about their corresponding first pin 230 to rotate the carrier 225. The compound gear 245 rotates with the carrier 225 about the rotational axis 95 to drive the second stage planetary gears 260 about their corresponding second pin 275. Ultimately, the first stage planetary gears 220 drive the first ring gear 240 and the second stage planetary gears 260 drive the second ring gear 285 to rotate the cutting bit assemblies 100 about the rotational axis 95 to cut material from the mine face 360. The cut material is then deposited on the conveyor assembly 340, and the conveyor assembly 340 moves the cut material away from the mine face 360. While the first and second cutting assemblies 15 are cutting material from the mine face 360, the shearer 10 trams along the track 35 in the first direction 40 or the second direction 45. Accordingly, with each pass of the shearer 10 along the mine face 360 in the first direction 40 or the second direction 45, a section of material 375 is cut from the mine face 360 (FIG. 8).

In the illustrated embodiment, the powertrain 80 includes a plurality of motors 125 that rotate the drum 90 about the rotational axis 95 through two planetary stages to provide torque to exert a cutting force to cut material from the mine face 360. In other embodiments, the powertrain 80 can be configured differently but still provide torque to exert a cutting force to cut material from the mine face 360. For example, the powertrain 80 can include fewer or more than three motors 125 and/or fewer or more than two planetary stages.

FIGS. 9-14 illustrate a cutting assembly 15*a* according to another embodiment. The cutting assembly 15*a* is similar to the cutting assembly 15; therefore, similar components are designated with similar references numbers and include the letter "a." At least some differences and/or at least some similarities between the cutting assemblies 15, 15*a* will be discussed in detail below. In addition, components or features described with respect to the cutting assembly 15*a* can be similarly applicable to any other embodiments described herein.

Figure 9:
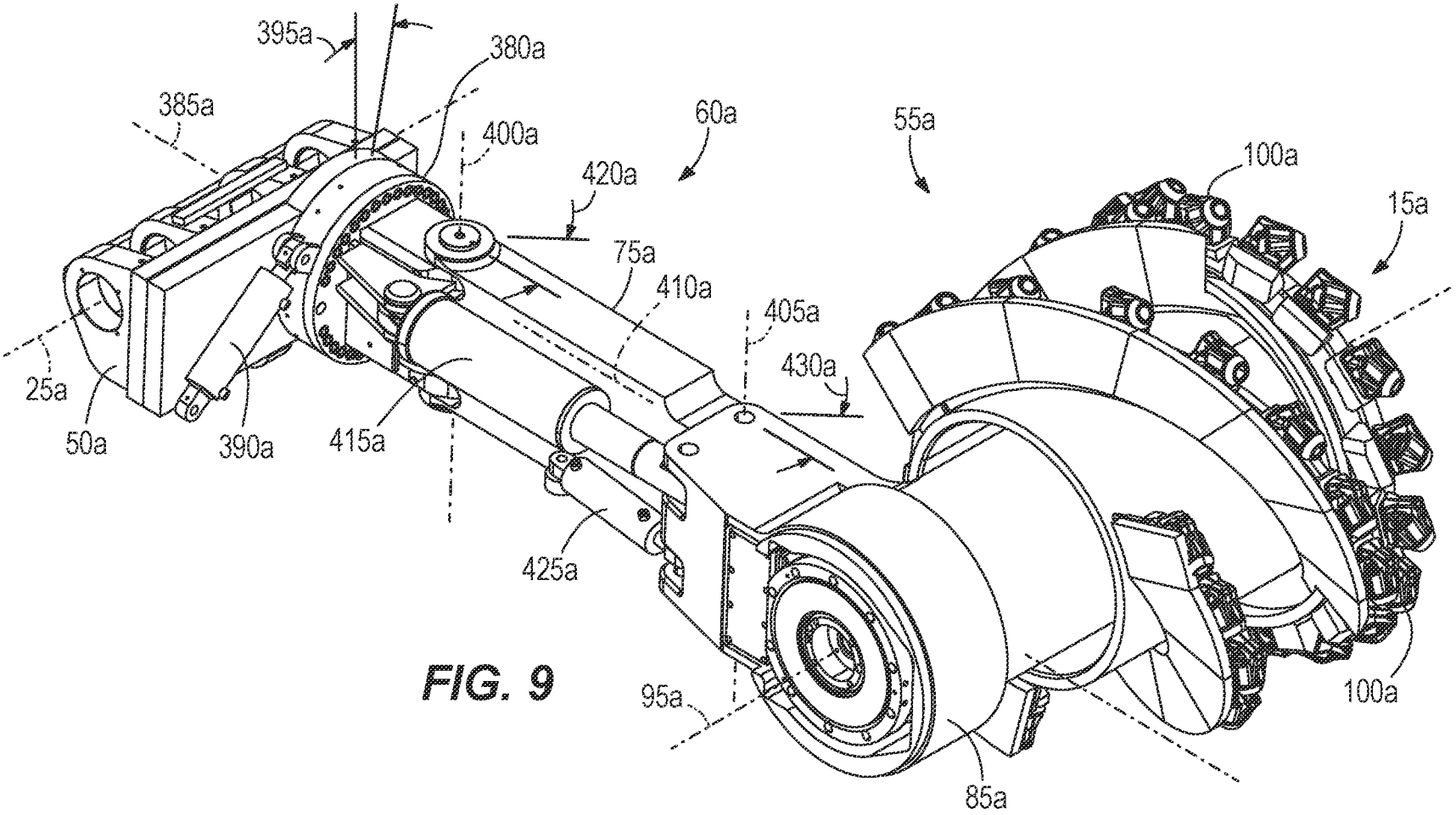
FIG. 9 is a first perspective view of a cutting assembly according to another embodiment.
Figure 10:
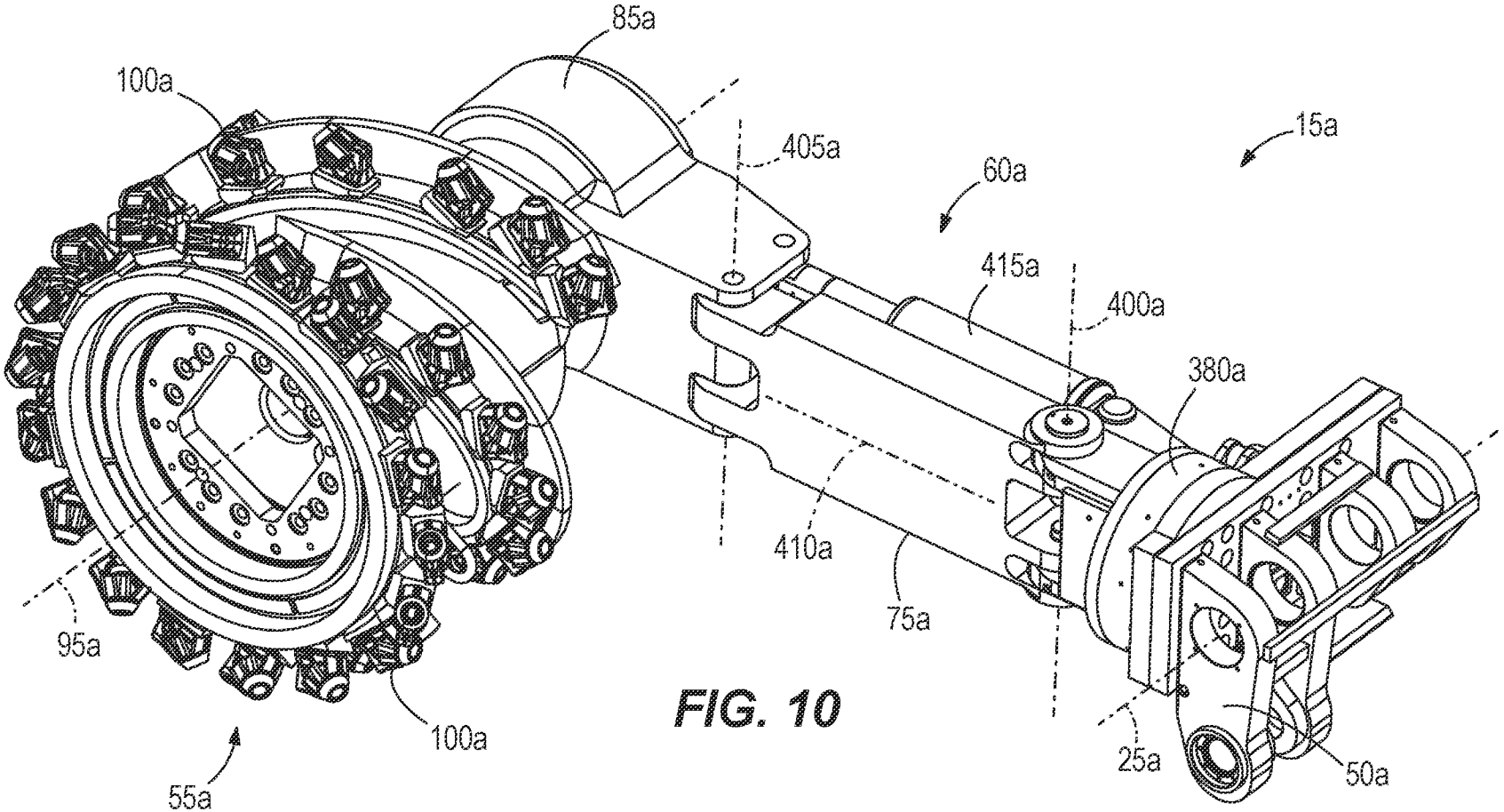
FIG. 10 is a second perspective view of the cutting assembly of FIG. 9.

With reference to FIGS. 9 and 10, a support structure 60*a* includes a base 380*a* that is pivotably coupled to a chassis mount 50*a* about a second axis 385*a*. The second axis 385*a* is perpendicular to a first axis 25*a*. In other embodiments, the second axis 385*a* can be obliquely oriented relative to the first axis 25*a*. As shown in FIG. 9, a first hydraulic actuator 390*a* is coupled to the chassis mount 50*a* and the base 380*a* and is operable to pivot the support structure 60*a* and a drum and motor assembly 55*a* relative to the chassis mount 50*a* within a first angular range 395*a*. In the illustrated embodiment, the first angular range 395*a* is about 10 degrees. In other embodiments, the first angular range 395*a* can be less than 20 degrees, 30 degrees, 40 degrees, etc. The first hydraulic actuator 390*a* is operable by the power unit 30.

With continued reference to FIGS. 9 and 10, the illustrated support structure 60*a* also includes a structural member 75*a* pivotably coupled to the base 380*a*. In particular, the structural member 75*a* is pivotably coupled to the base 380*a* about a third axis 400*a* that is perpendicular to the second axis 385*a*. In addition, the structural member 75*a* is pivotably coupled to a housing 85*a* of the drum and motor assembly 55*a* about a fourth axis 405*a*. The fourth axis 405*a* is perpendicular to a longitudinal axis 410*a* of the structural member 75*a*, which extends between the third and fourth axes 400*a*, 405*a*. As shown in FIG. 9, a second hydraulic actuator 415*a* is coupled to the base 380*a* and the housing 85*a* and is operable to pivot the structural member 75*a* and the drum and motor assembly 55*a* about the third axis 400*a* relative to the base 380*a* within a second angular range 420*a*. In the illustrated embodiment, the second angular range 420*a* is about 15 degrees. In other embodiments, the second angular range 420*a* can be between about 0 degrees and about 10 degrees, between about 0 degrees and about 20 degrees, between about 0 degrees and about 30 degrees, between about 0 degrees and about 40 degrees, etc. The second hydraulic actuator 415*a* is powered by the power unit 30.

In addition, as shown in FIG. 9, a third hydraulic actuator 425*a* is coupled to the structural member 75*a* and the housing 85*a*. The third hydraulic actuator 425*a* is operable to pivot the drum and motor assembly 55*a* about the fourth axis 405*a* relative to the support structure 60*a* within a third angular range 430*a*. In the illustrated embodiment, the third angular range 430*a* is about 15 degrees. In other embodiments, the third angular range 430*a* can be between about 0 degrees and about 10 degrees, between about 0 degrees and about 20 degrees, between about 0 degrees and about 30 degrees, between about 0 degrees and about 40 degrees, etc. The third hydraulic actuator 425*a* is operable by the power unit 30.

In operation, the drum and motor assembly 55*a* rotates about a rotational axis 95*a* for cutting bit assemblies 100*a* to cut material from the mine face 360. The drum and motor assembly 55*a* can also move about the first axis 25*a*, move about the second axis 385*a* within the first angular range 395*a*, move about the third axis 400*a* within the second angular range 420*a*, and move about the fourth axis 405*a* within the third angular range 430*a*. Accordingly, the drum and motor assembly 55*a* includes five degrees of movement and can simultaneously or independently move in any combination of the five degrees of movement. In other embodiments, the drum and motor assembly 55*a* can include at least three degrees of movement (e.g., movement about the first axis 25*a*, movement about the rotational axis 95*a*, and movement within one of the first angular range 395*a*, within the second angular range 420*a*, or within the third angular range 430*a*). That is, it is understood that the drum and motor assembly 55*a* may be constructed with one or two of the three points of articulation illustrated at axis 385*a*, 400*a*, and 405*a*.

Figure 11:
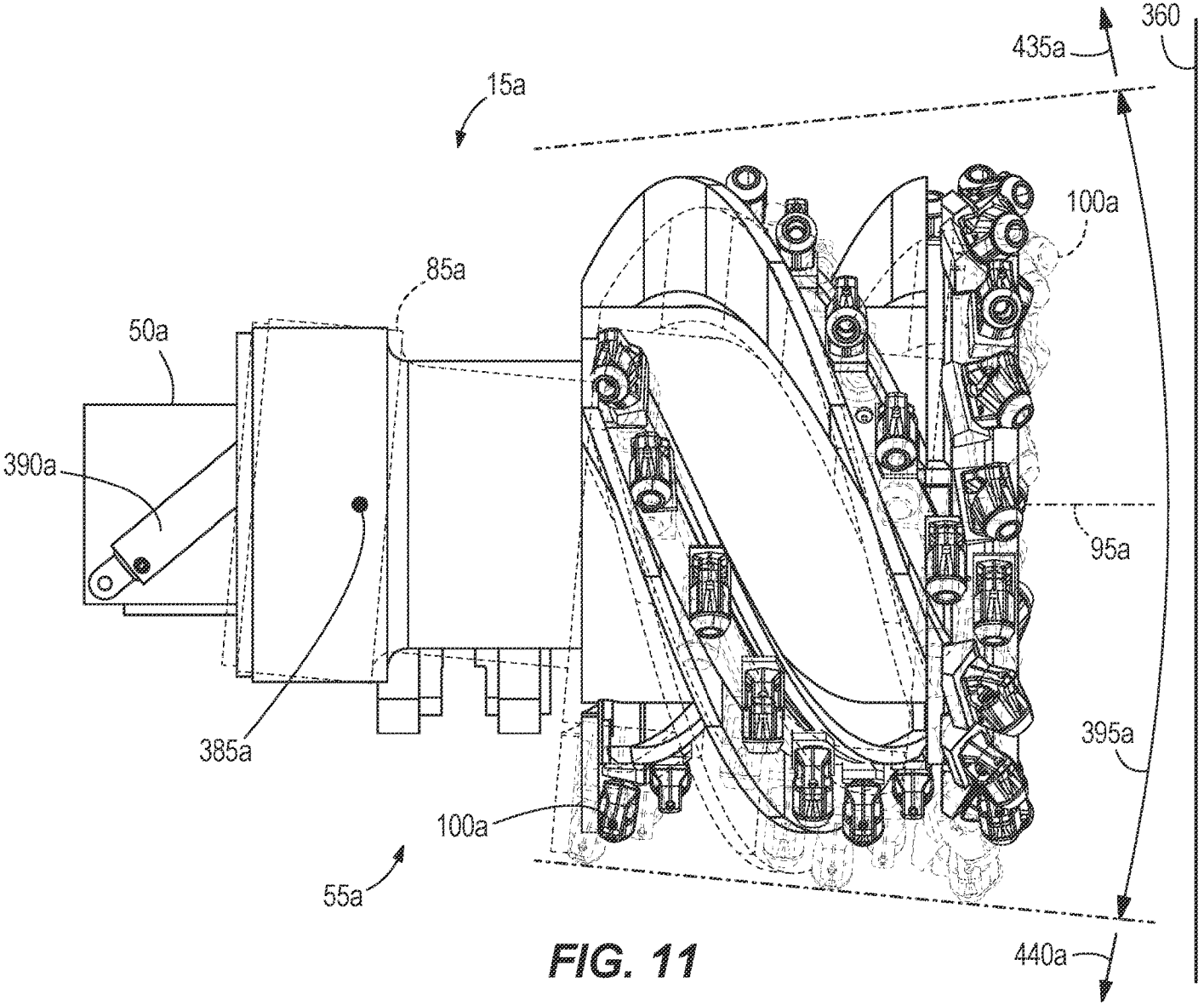
FIG. 11 is a side view of the cutting assembly of FIG. 9 illustrating a first range of motion of the cutting assembly.

With reference to FIG. 11, the rotational axis 95*a* of the drum and motor assembly 55*a* can move in an upward tilt direction 435*a* or a downward tilt direction 440*a* within the first angular range 395*a*. Accordingly, the cutting assembly 15*a* can shape the mine face 360 relative to the mine floor 350. For example, in some situations the mine floor 350 and the mine face 360 may not be perpendicular to each other as shown in FIG. 8. As such, the drum and motor assembly 55*a* can move in the tilt directions 435*a*, 440*a* to ensure the mine face 360 is perpendicular to the forward direction 355 and/or the mine floor 350 as the shearer 10 moves in the first direction 40 or the second direction 45.

Figure 12:
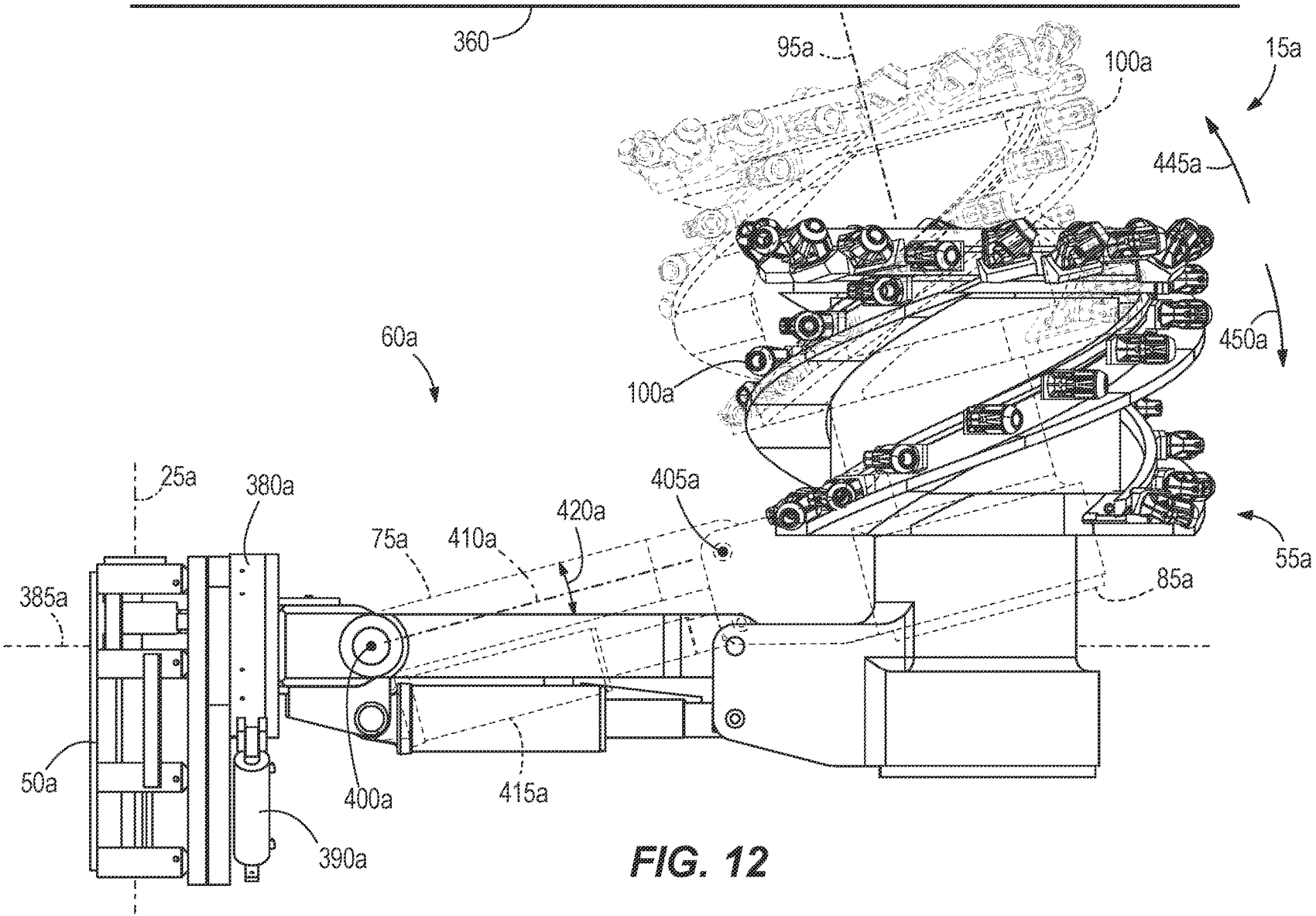
FIG. 12 is a top view of the cutting assembly of FIG. 9 illustrating a second range of motion of the cutting assembly.
Figure 13:
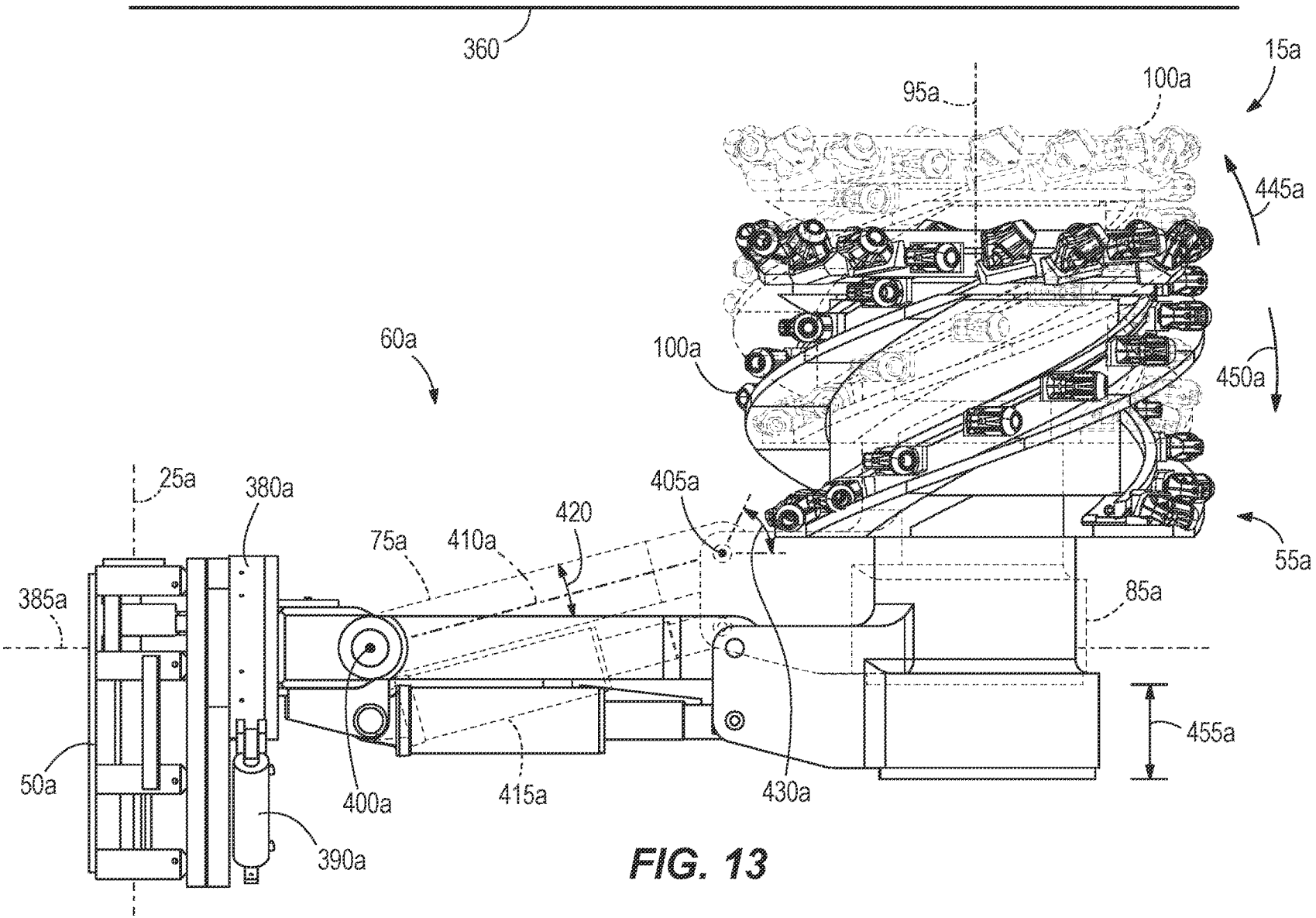
FIG. 13 is a top view of the cutting assembly of FIG. 9 illustrating a third range of motion of the cutting assembly.

With reference to FIG. 12, the rotational axis 95*a* of the drum and motor assembly 55*a* is movable about the third axis 400*a* in a first swing direction 445*a* or a second swing direction 450*a* within the second angular range 420*a*. In addition, with reference to FIG. 13, the rotational axis 95*a* of the drum and motor assembly 55*a* is movable about the fourth axis 405*a* in the first swing direction 445*a* or the second swing direction 450*a* within the third angular range 430*a*. Accordingly, the drum and motor assembly 55*a* can cut into the mine face 360 in the forward direction 355 while maintaining the rotational axis 95*a* of the drum and motor assembly 55*a* perpendicular to the mine face 360 (FIG. 13), without the roof supports 345 pushing the shearer 10 in the forward direction 355. In particular, the drum and motor assembly 55*a* is extendable in the forward direction 355 by a distance 455*a* relative to the chassis 20 while maintaining the rotational axis 95*a* of the drum and motor assembly 55*a* perpendicular to the mine face 360. In the illustrated embodiment, the distance 455*a* is between 300 millimeters and 400 millimeters (e.g., 324 millimeters).

Figure 14:
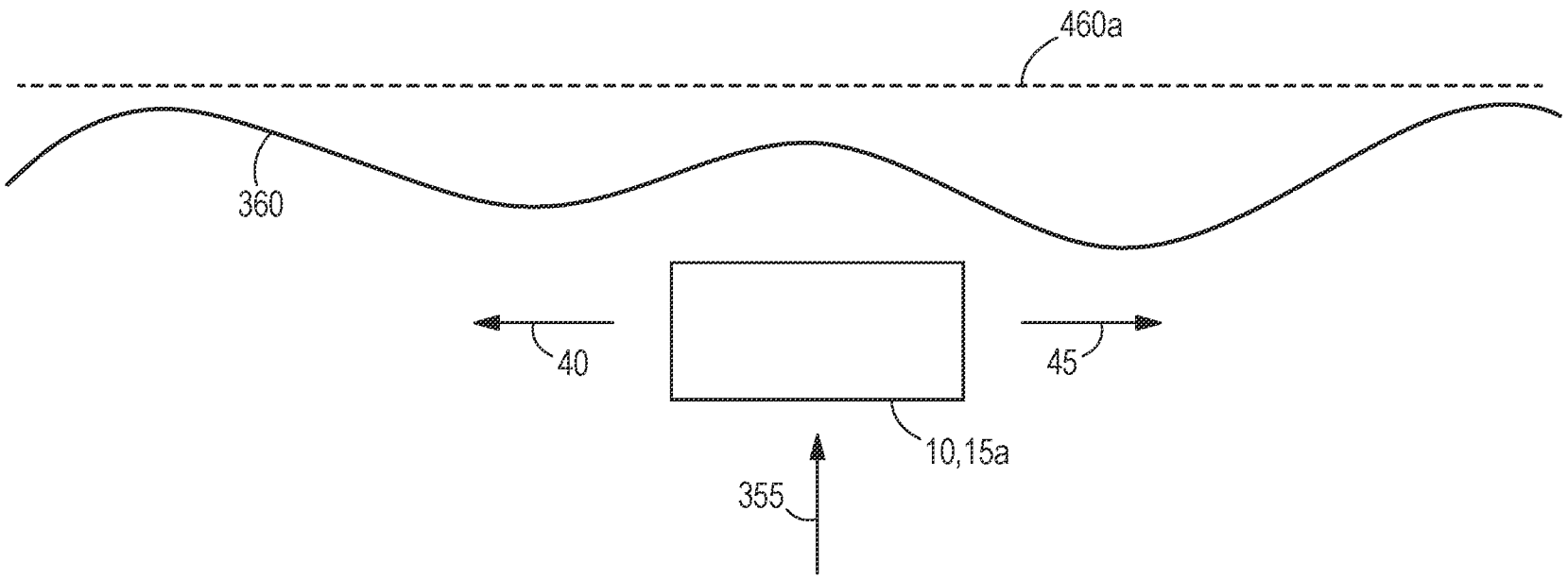
FIG. 14 is a top view of the mining machine of FIG. 1 during operation including the cutting assemblies of FIG. 9.

Accordingly, the illustrated shearer 10 can adjust an orientation of the drum and motor assembly 55*a* while the shearer 10 is moving in the first direction 40, the second direction 45, and/or the forward direction 355. Adjusting the orientation of the drum and motor assembly 55*a* provides greater control of material being cut from the mine face 360. For example, during operation, the track 35 along which the mining machine 10 trams may deviate relative to the direction of advance causing the mining machine 10 to move off of a desired cutting path. Such deviation may cause the mining machine 10 to cut the mine face 360 in an undesirable manner (e.g., nonlinearly as shown in FIG. 14). The illustrated cutting assembly 15*a* can be adjusted to cut material to a desired linear line 460*a* from the mine face 360 while the shearer 10 moves in the first direction 40, the second direction 45, and/or the forward direction 355. In particular, the cutting assembly 15*a* can be adjusted to account for deviations of the mining machine 10 during operation. The adjustability of the cutting assembly 15*a* within the first, second, and third angular ranges 395*a*, 420*a*, 430*a* also inhibits overloading the cutting bit assemblies 100*a* by controlling a depth of the section 375 being cut from the mine face 360.

FIGS. 15-19 illustrate a cutting assembly 15*b* according to another embodiment. The cutting assembly 15*b* is similar to the cutting assemblies 15, 15*a*; therefore, similar components are designated with similar references numbers and include the letter "b.". At least some differences and/or at least some similarities between the cutting assemblies 15, 15*a*, 15*b* will be discussed in detail below. In addition, components or features described with respect to the cutting assembly 15*b* can be similarly applicable to any other embodiments described herein.

Figure 15:
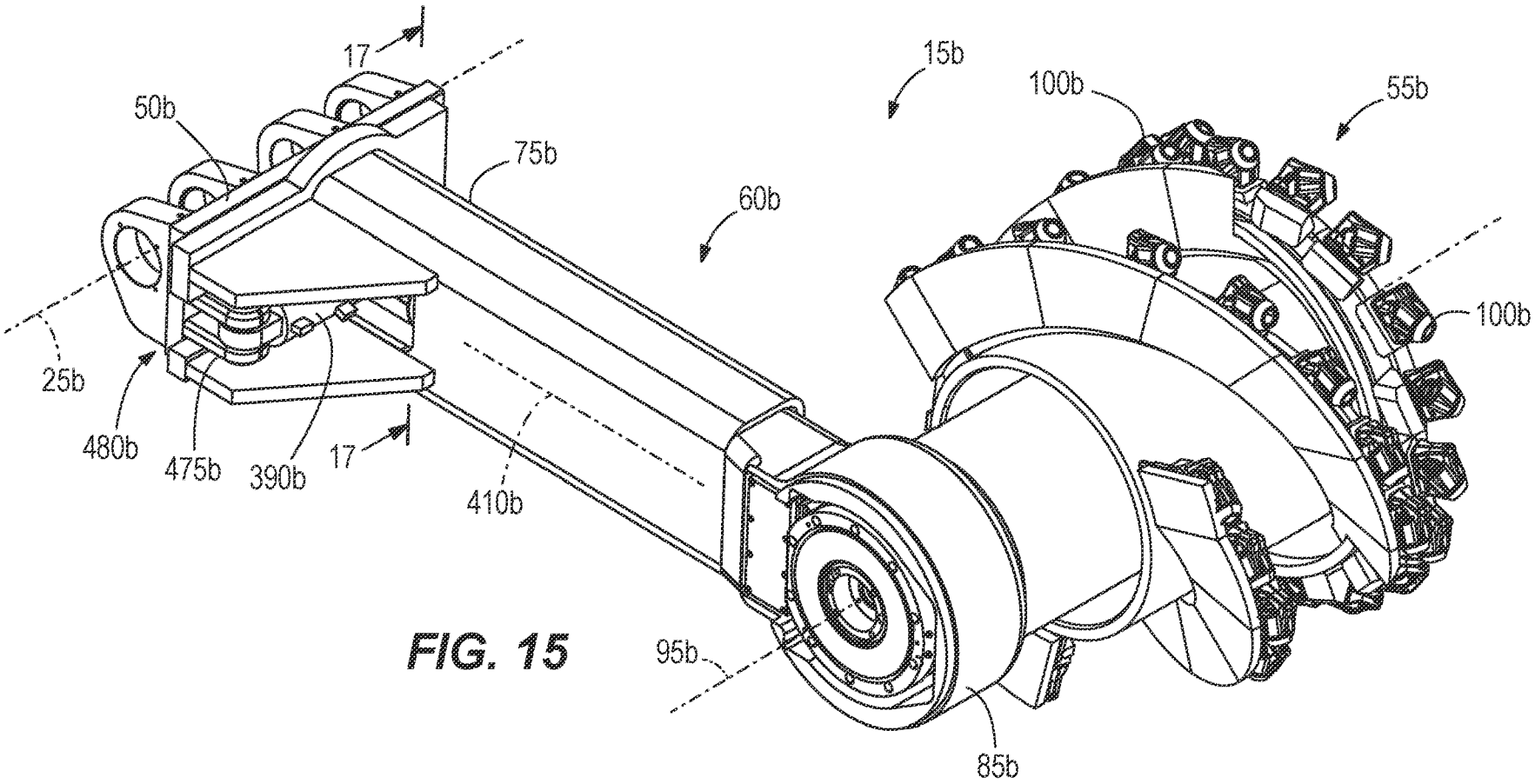
FIG. 15 is a perspective view of a cutting assembly according to another embodiment.
Figure 16:
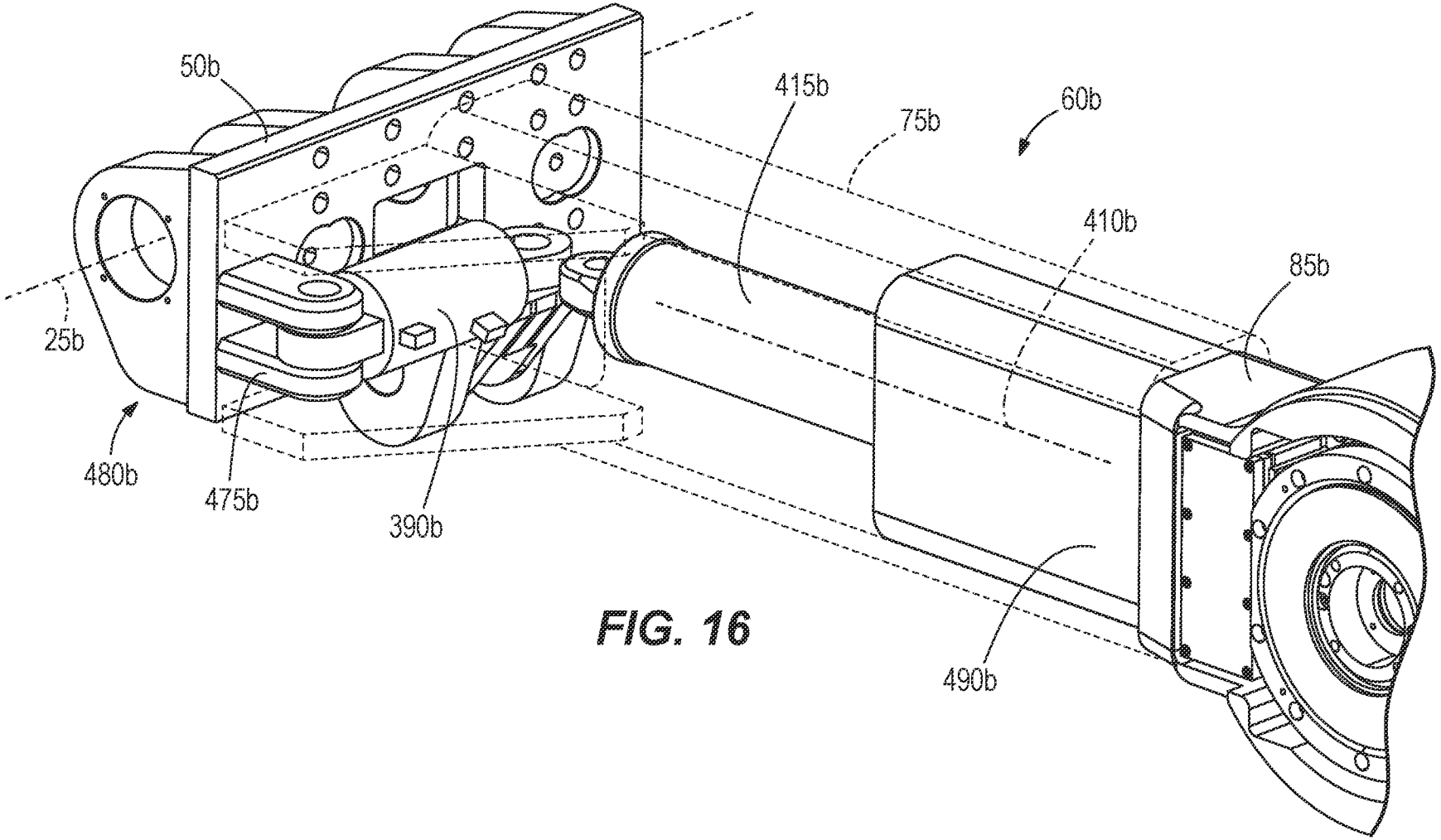
FIG. 16 is a perspective view of a portion of the cutting assembly of FIG. 15.
Figure 17:
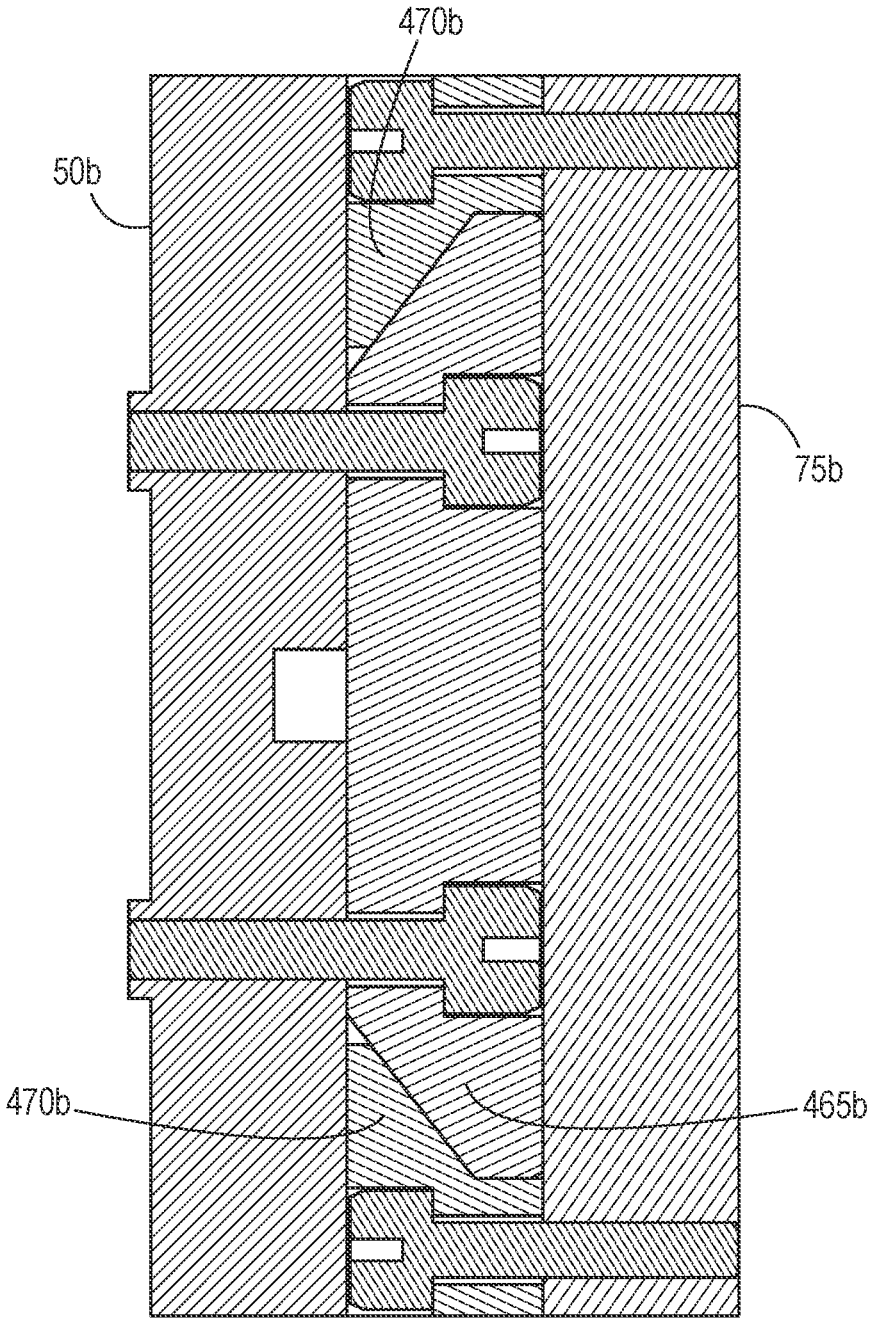
FIG. 17 is a cross sectional view of the cutting assembly taken along line 17-17 of FIG. 15.
Figure 18:
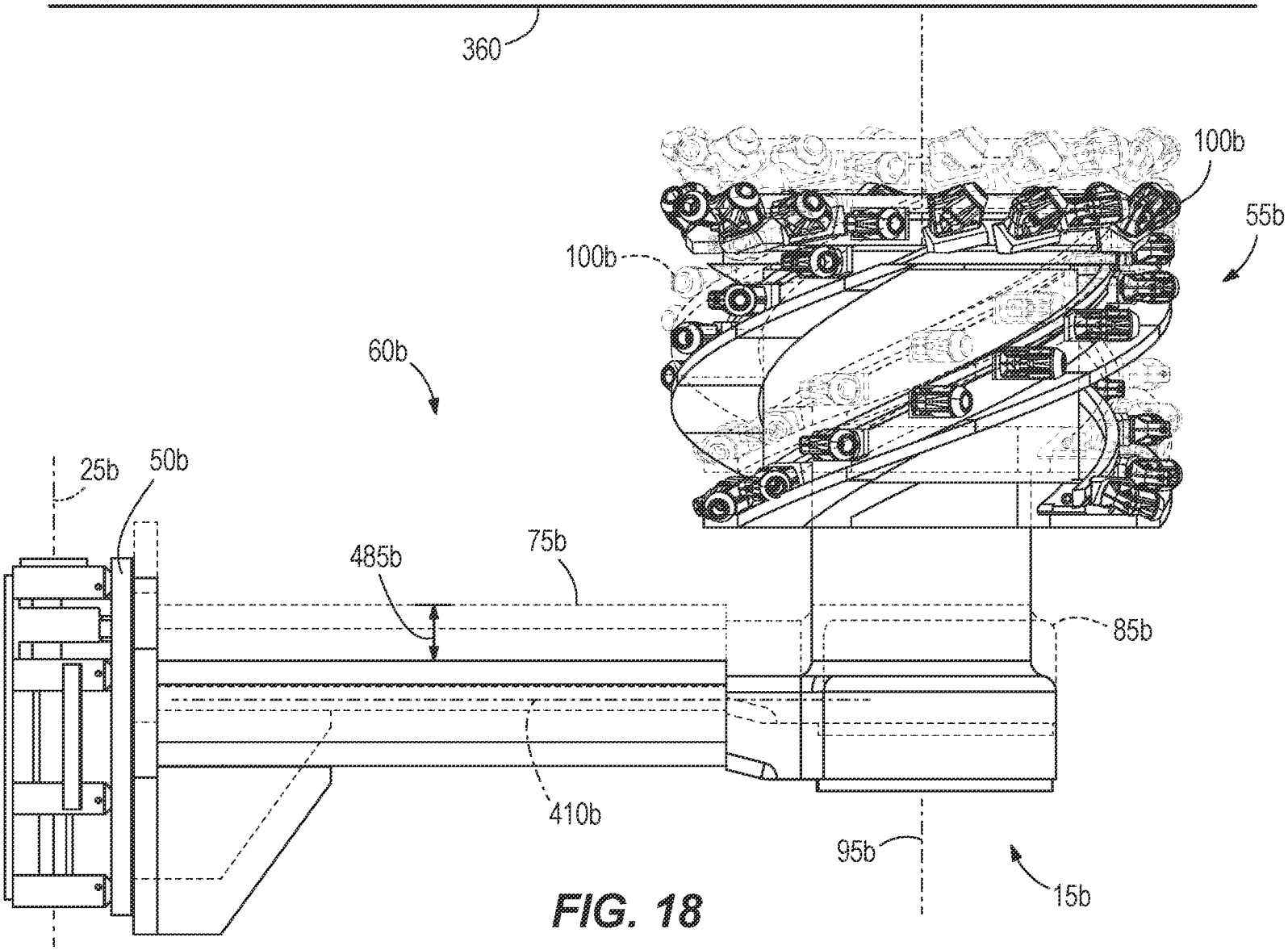
FIG. 18 is a top view of the cutting assembly of FIG. 15 illustrating a first range of motion of the cutting assembly.

With reference to FIGS. 15 and 16, a support structure 60*b* includes a structural member 75*b* that is slidably coupled to a chassis mount 50*b* in a direction parallel to a first axis 25*b*. With reference to FIG. 17, an interface between the support structure 60*b* and the chassis mount 50*b* includes a dovetail slider configuration. In particular, a slider 465*b* is fixed to the chassis mount 50*b* with protrusions 470*b* of the structural member 75*b* griping the slider 465*b* allowing the structural member 75*b* to slide relative to the chassis mount 50*b*. In other embodiments, the slider 465*b* can be coupled to the structural member 75*b* and the protrusions 470*b* can be coupled to the chassis mount 50*b*. With reference back to FIGS. 15 and 16, a first hydraulic actuator 390*b* is coupled to a bracket 475*b* of the chassis mount 50*b* and the structural member 75*b*. The bracket 475*b* is received within a slot 480*b* of the structural member 75*b*. The first hydraulic actuator 390*b* is operable to translate the support structure 60*b* and a drum and motor assembly 55*b* relative to the chassis mount 50*b* within a first translational range or distance 485*b* (FIG. 18). In the illustrated embodiment, the first translational distance 485*b* is between about 100 millimeters and about 200 millimeters (e.g., about 165 millimeters). In other embodiments, the first translational distance 485*b* can be less than 500 millimeters.

Figure 19:
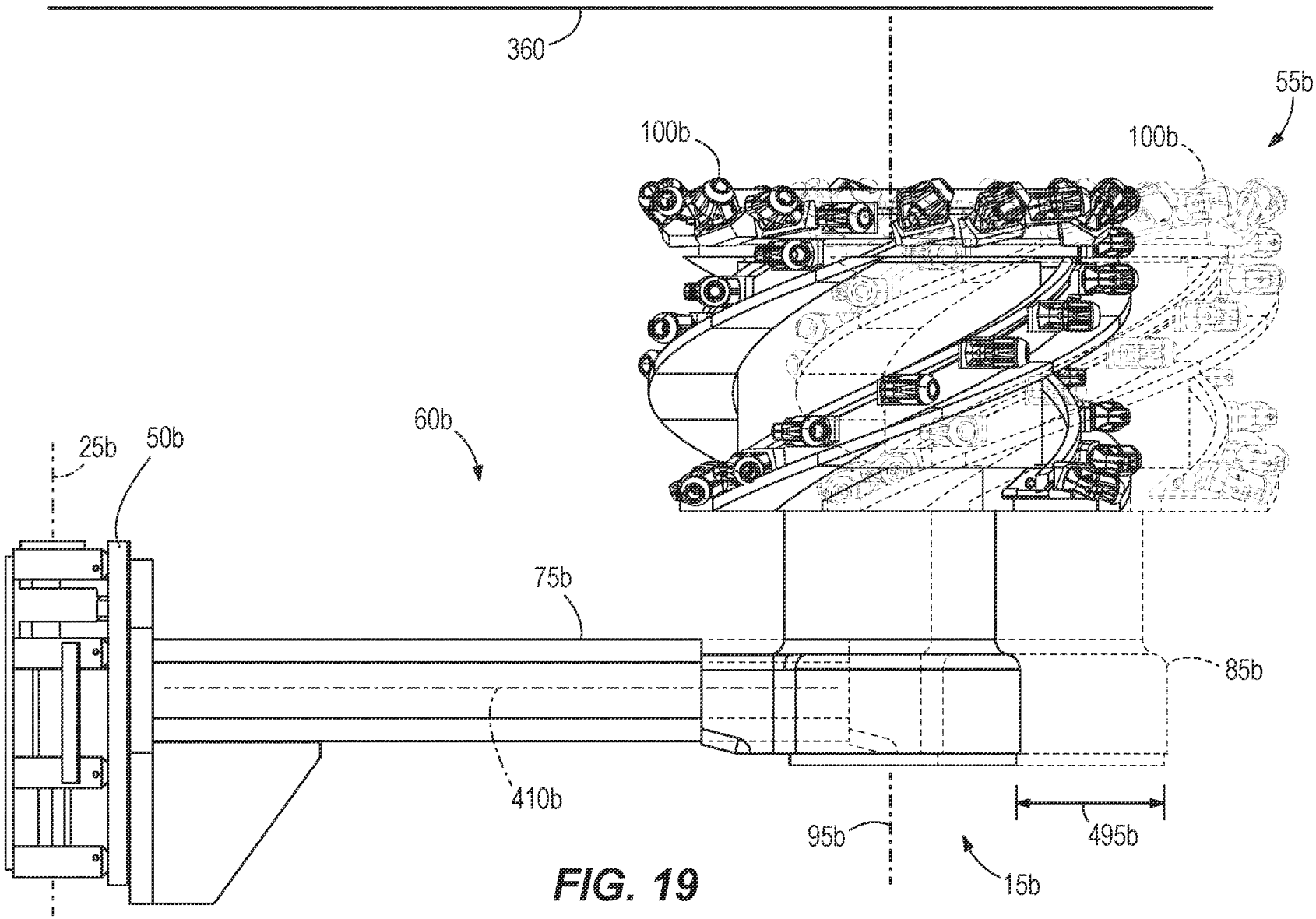
FIG. 19 is a top view of the cutting assembly of FIG. 15 illustrating a second range of motion of the cutting assembly.

With reference to FIG. 16, a second hydraulic actuator 415*b* is positioned within the structural member 75*b* (e.g., a hollow structural member) to be coupled between the structural member 75*b* and an arm 490*b* of a housing 85*b*. The arm 490*b* is received within the structural member 75*b* (e.g., the structural member 75*b* is a sleeve to the arm 490*b*). The second hydraulic actuator 415*b* is operable to translate the drum and motor assembly 55*b* relative to the structural member 75*b* in a direction parallel to a longitudinal axis 410*b* of the structural member 75*b* within a second translational range or distance 495*b* (FIG. 19). The longitudinal axis 410*b* is perpendicular to the first axis 25*b*. In the illustrated embodiment, the second translational distance 495*b* is between about 300 millimeters and about 700 millimeters (e.g., about 499 millimeters). In other embodiments, the second translational distance 495*b* can be less than 1000 millimeters.

In operation, the drum and motor assembly 55*b* rotates about a rotational axis 95*b* for cutting bit assemblies 100*b* to cut material from the mine face 360. The drum and motor assembly 55*b* can also move about the first axis 25*b*, move along the first axis 25*b* within the first translational range 485*b*, and move along the longitudinal axis 410*b* within the second translational range 495*b*. Accordingly, the drum and motor assembly 55*b* includes four degrees of movement while cutting bit assemblies 100*b* cut into the mine face 360. In other embodiments, the drum and motor assembly 55*b* can include at least three degrees of movement (e.g., movement about the first axis 25*b*, movement about the rotational axis 95*b*, and movement within the first translational range 485*b* or the second translational range 495*b*).

FIGS. 20-23 illustrate a cutting assembly 15*c* according to another embodiment. The cutting assembly 15*c* is similar to the cutting assemblies 15, 15*a*, 15*b*; therefore, similar components are designated with similar references numbers and include the letter "c." At least some differences and/or at least some similarities between the cutting assemblies 15, 15*a*, 15*b*, 15*c* will be discussed in detail below. In addition, components or features described with respect to the cutting assembly 15*c* can be similarly applicable to any other embodiments described herein.

Figure 20:
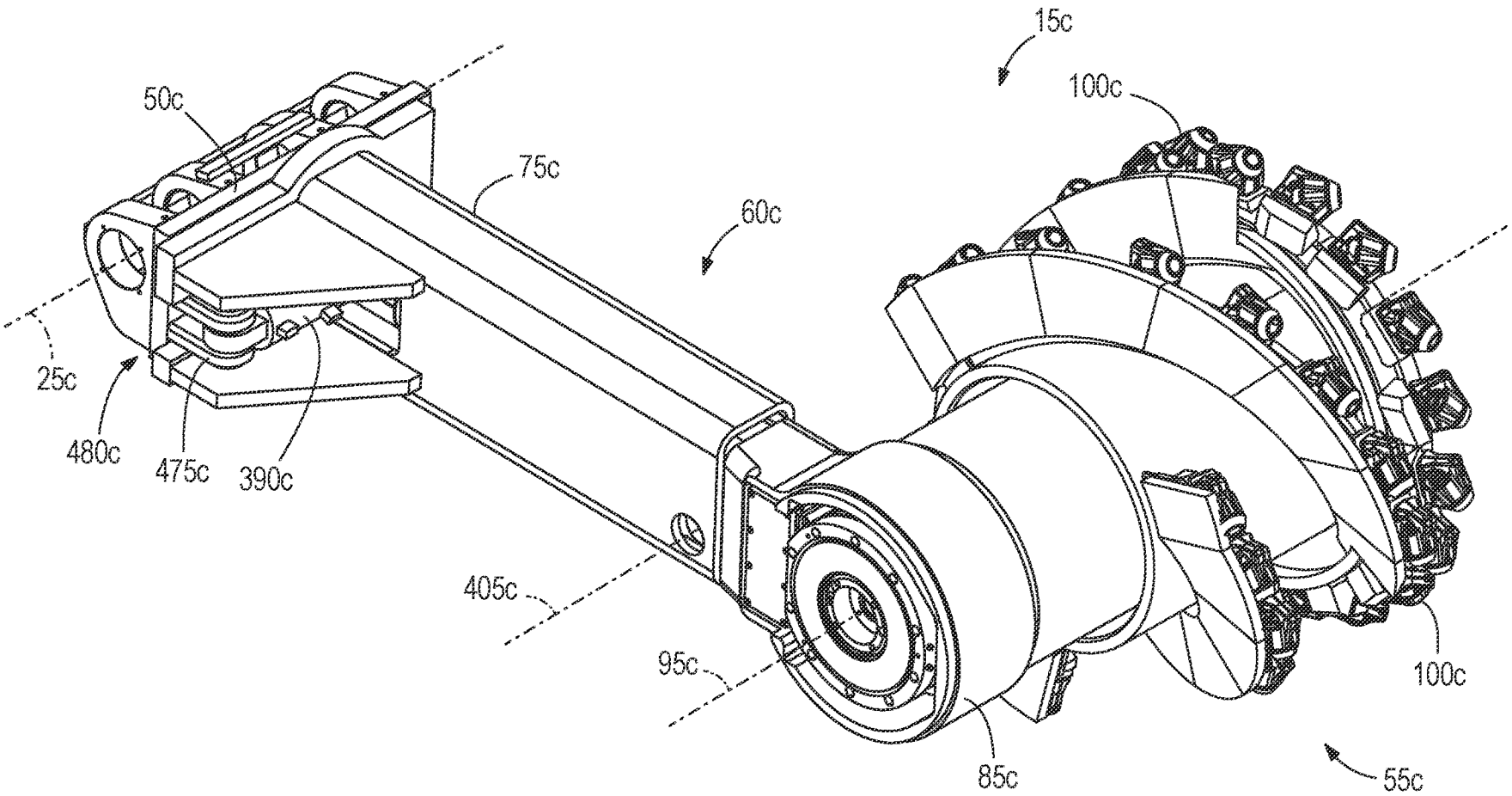
FIG. 20 is a perspective view of a cutting assembly according to another embodiment.
Figure 21:
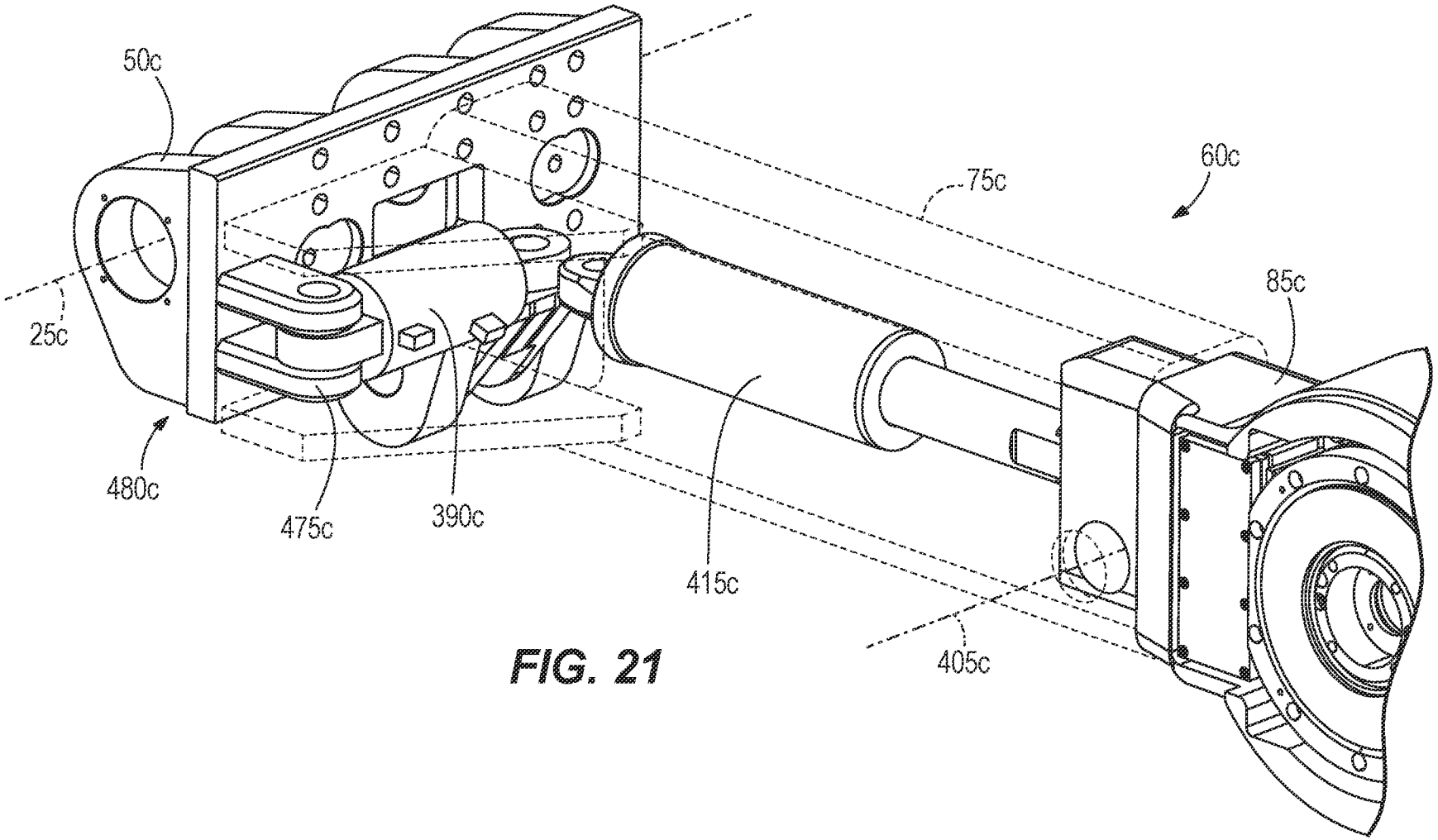
FIG. 21 is a perspective view of a portion of the cutting assembly of FIG. 20.
Figure 22:
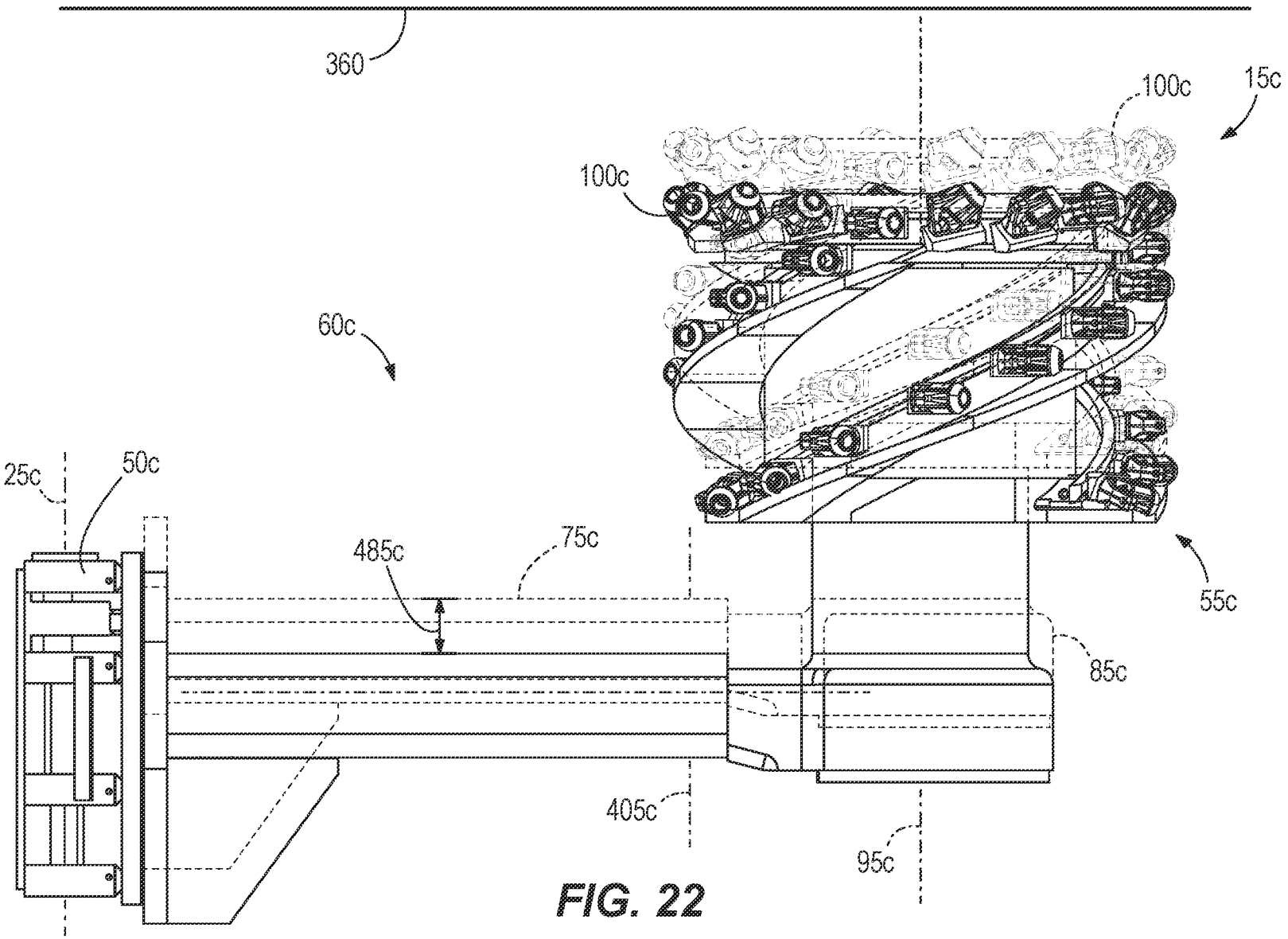
FIG. 22 is a top view of the cutting assembly of FIG. 20 illustrating a first range of motion of the cutting assembly.

With reference to FIGS. 20 and 21, a support structure 60*c* includes a structural member 75*c* that is slidably coupled to a chassis mount 50*c* in a direction parallel to a first axis 25*c*. An interface between the support structure 60*c* and the chassis mount 50*c* includes a dovetail slider configuration, as described above. A first hydraulic actuator 390*c* is coupled to a bracket 475*c* of the chassis mount 50*c* and the structural member 75*c*. The bracket 475*c* is received within a slot 480*c* of the structural member 75*c*. The first hydraulic actuator 390*c* is operable to translate the support structure 60*c* and a drum and motor assembly 55*c* relative to the chassis mount 50*c* within a translational range or distance 485*c* (FIG. 22).

Figure 23:
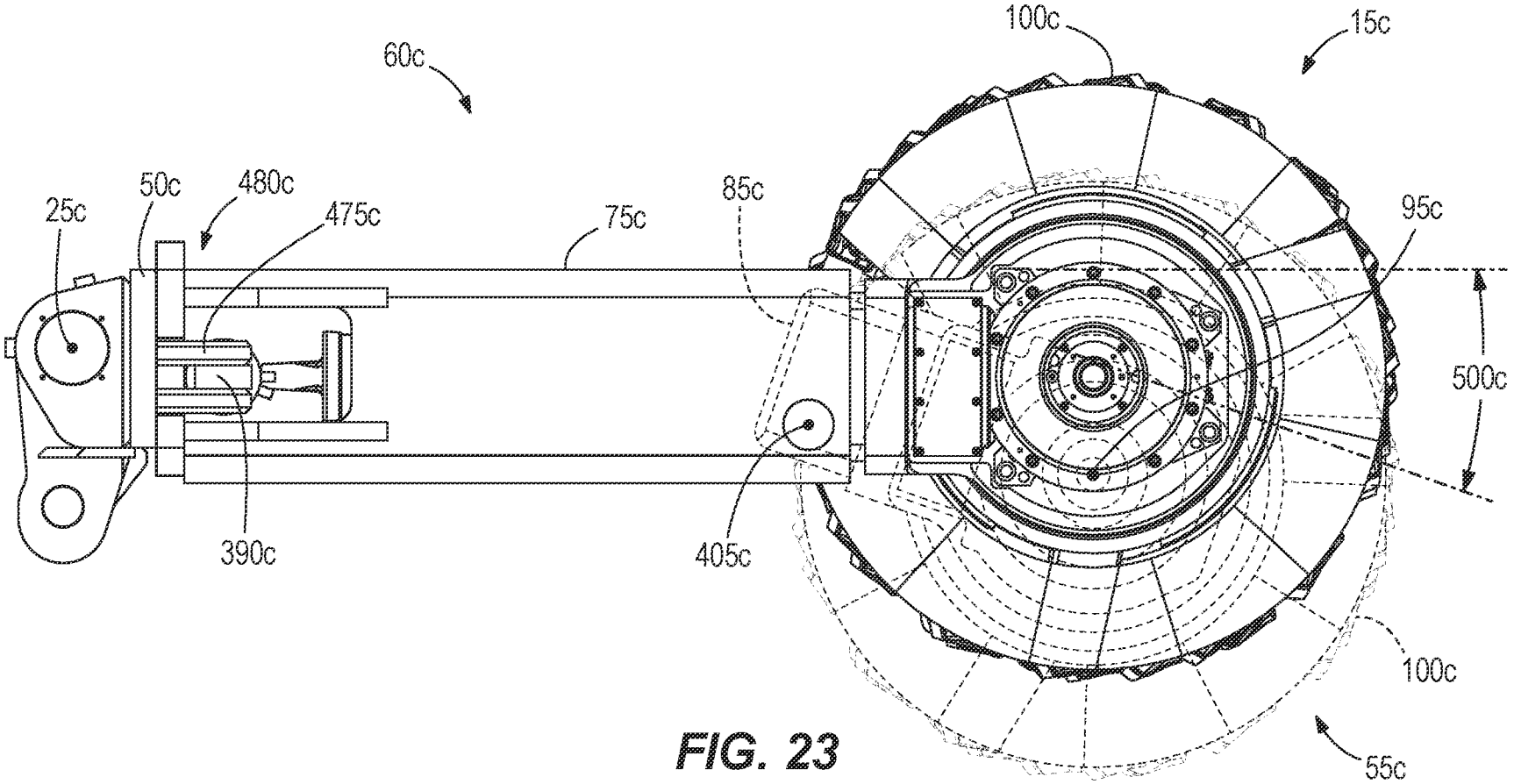
FIG. 23 is a side view of the cutting assembly of FIG. 20 illustrating a second range of motion of the cutting assembly.

As shown in FIG. 21, a second hydraulic actuator 415*c* is coupled to the structural member 75*c* and a housing 85*c*. The drum and motor assembly 55*c* is pivotably coupled to the structural member 75*c* about a fourth axis 405*c*. The fourth axis 405*c* is parallel to the first axis 25*a*. The second hydraulic actuator 415*c* is operable to rotate the drum and motor assembly 55*c* relative to the structural member 75*c* within an angular range 500*c* (FIG. 23). In the illustrated embodiment, the angular range 500*c* is between about 10 degrees and about 30 degree (e.g., about 20 degrees). In other embodiments, the angular range 500*c* can be less than 50 degrees.

In operation, the drum and motor assembly 55*c* rotates about a rotational axis 95*c* for cutting bit assemblies 100*c* to cut material from the mine face 360. The drum and motor assembly 55*c* can also move about the first axis 25*c*, move along the first axis 25*c* within the translational range 485*c*, and move about the fourth axis 405*c* within the angular range 500*c*. Accordingly, the drum and motor assembly 55 includes four degrees of movement. In other embodiments, the drum and motor assembly 55*c* can include at least three degrees of movement (e.g., movement about the first axis 25*c*, movement about the rotational axis 95*c*, and movement within the translational range 485*c* or within the angular range 500*c*).

Figure 24:
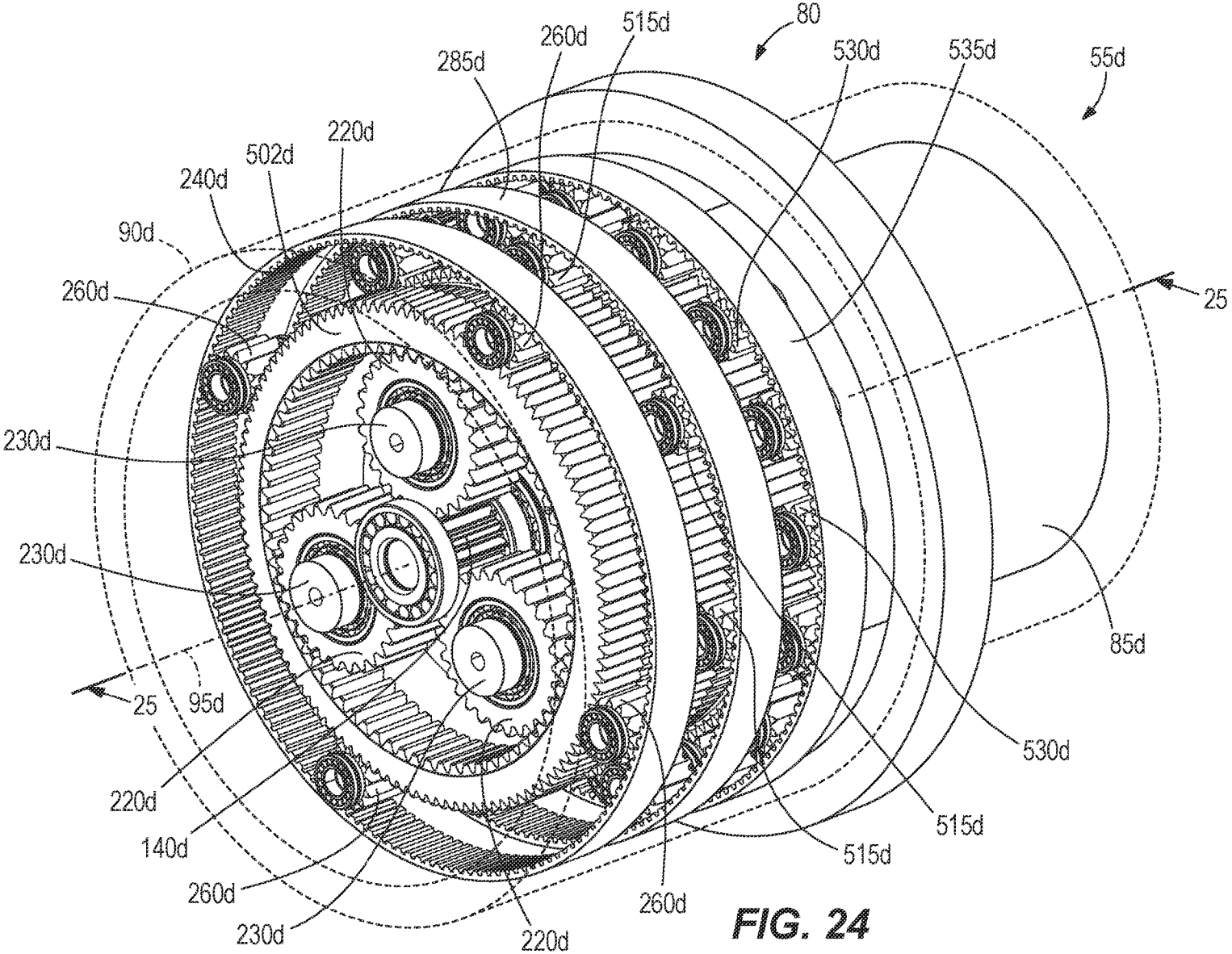
FIG. 24 is a perspective view of a powertrain according to another embodiment that drives a cutting drum of a cutting assembly.
Figure 25:
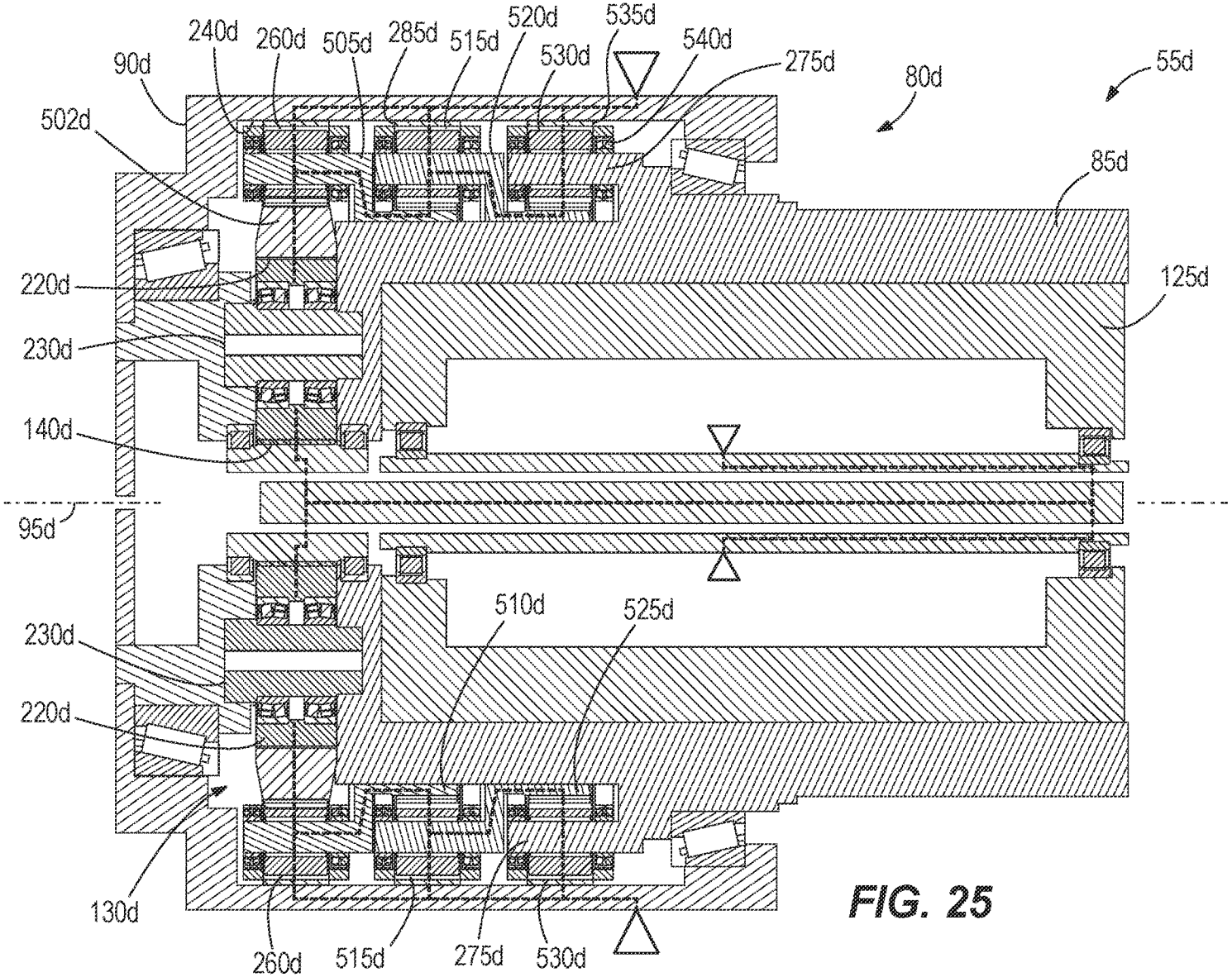
FIG. 25 is a cross sectional view of the powertrain taken along line 25-25 of FIG. 24.

FIGS. 24 and 25 illustrate a drum and motor assembly 55*d* according to another embodiment. The drum and motor assembly 55*d* is similar to the drum and motor assembly 55; therefore, similar components are designated with similar references numbers and including the letter "d." At least some differences and/or at least some similarities between the drum and motor assemblies 55, 55*d* will be discussed in detail below. Additionally, any of the cutting assemblies 15, 15*a*, 15*b*, 15*c* discussed above can include the drum and motor assembly 55*d*.

The drum and motor assembly 55*d* includes a powertrain 80*d* supported by a housing 85*d* and operable to drive a drum 90*d* about a rotational axis 95*d*. The illustrated housing 85*d* supports a single motor 125*d* (e.g., an electric motor, a hydraulic motor, etc.). In the illustrated embodiment, the powertrain 80*d* is a four-stage planetary gear train. In other embodiments, the powertrain 80*d* can include fewer than four planetary stages or more than four planetary stages.

In particular, the motor 125*d* is coupled to an output pinion 140*d* that is rotatable about the rotational axis 95*d*. The output pinion 140*d* engages a plurality of first stage planetary gears 220*d* that are coupled to the housing 85*d* by first pins 230*d*. In particular, the first stage planetary gears 220*d* are rotatable about their corresponding first pin 230*d* via bearings, and the first pins 230*d* are rotatably fixed about the rotational axis 95*d*. In addition, the first stage planetary gears 220*d* are engaged with a first ring gear 502*d*. The first ring gear 502*d* is rotatable about the rotational axis 95*d*.

A plurality of second stage planetary gears 260*d* are coupled together by a second stage carrier 505*d* such that the second stage planetary gears 260*d* and the second stage carrier 505*d* are rotatable about the rotational axis 95*d*. The plurality of second stage planetary gears 260*d* engage the first ring gear 502*d* and a first portion 240*d* of the drum 90*d*. In the illustrated embodiment, the first stage planetary gears 220*d* and the second stage planetary gears 260*d* are aligned in a radial direction along the rotational axis 95*d*. In other embodiments, however, the first stage planetary gears 220*d* and the second stage planetary gears 260*d* can be offset along the rotational axis 95*d* (e.g., a ring gear spans between the first stage planetary gears 220*d* and the second stage planetary gears 260*d*). The second stage carrier 505*d* includes a third stage ring gear portion 510*d* that engages a plurality of third stage planetary gears 515*d*. The third stage planetary gears 515*d* also engage a second portion 285*d* of the drum 90*d*. The plurality of third stage planetary gears 515*d* are coupled together by a third stage carrier 520*d* such that the third stage planetary gears 515*d* and the third stage carrier 520*d* are rotatable about the rotational axis 95*d*. The third stage carrier 520*d* includes a fourth stage ring gear portion 525*d* that engages a plurality of fourth stage planetary gears 530*d*. The fourth stage planetary gears 530*d* also engage a third portion 535*d* of the drum 90*d*. The plurality of fourth stage planetary gears 530*d* are coupled together by a fourth stage carrier 540*d*, and the fourth stage carrier 540*d* is rotatably fixed about the rotational axis 95*d*. In particular, the fourth stage planetary gears 530*d* are rotatable about a corresponding second pin 275*d* coupled to the fourth stage carrier 540*d*, and the second pins 275*d* are rotatably fixed about the rotational axis 95*d*. As such, the fourth stage planetary gears 530*d* are also rotatably fixed about the rotational axis 95*d*.

In operation, the motor 125*d* drives the output pinion 140*d* to drive the first stage planetary gears 220*d* about their respective first pin 230*d*. In turn, the first ring gear 502*d* rotates about the rotational axis 95*d* to drive the second stage planetary gears 260*d*. The second stage planetary gears 260*d* then rotate about the rotational axis 95*d* to also move the third stage ring gear portion 510*d* about the rotational axis 95*d*. The third stage ring gear portion 510*d* drives the third stage planetary gears 515*d* about the rotational axis 95, which also moves the fourth stage ring gear portion 525*d* about the rotational axis 95. The fourth stage ring gear portion 525*d* then rotates the fourth stage planetary gears 530*d* about their respective second pin 275*d*. Accordingly, the drum 90*d* is driven about the rotational axis 95*d* via engagements of the second stage, third stage, and fourth stage planetary gears 260*d*, 515*d*, 530*d* and the portions 240*d*, 285*d*, 535*d*.

Although certain aspects have been described in detail with reference to certain preferred embodiments, variations and modifications exist within the scope and spirit of one or more independent aspects as described. Various features and advantages of the disclosure are set forth in the following claims.

The invention claimed is:

1. A cutting assembly for a mining machine, the cutting assembly comprising:

a mount configured to move about a first pivot axis relative to a chassis of the mining machine;

a ranging arm coupled to the mount, the ranging arm moveable relative to the mount along a first translational axis parallel to the first pivot axis; and a cutting head including, a housing coupled to the ranging arm, the housing moveable relative to the ranging arm along a second translational axis transverse to the first translational axis, a drum supported for rotation relative to the housing about a rotational axis, a plurality of cutting bits coupled to the drum, and at least one motor supported by the housing to drive the drum about the rotational axis.

2. The cutting assembly of claim 1, wherein the cutting head includes at least two motors supported by the housing.

3. The cutting assembly of claim 2, wherein the housing supports at least a two-stage planetary transmission between the at least two motors and the drum to drive the drum about the rotational axis.

4. The cutting assembly of claim 1, wherein the cutting head includes at least a four-stage transmission coupled between the at least one motor and the drum to drive the drum about the rotational axis.

5. The cutting assembly of claim 1, wherein the ranging arm includes a plurality of hollow structural members.

6. The cutting assembly of claim 1, wherein the cutting head includes a single motor, wherein the housing supports at least a four-stage planetary transmission between the single motor and the drum to drive the drum about the rotational axis.

7. The cutting assembly of claim 1, wherein the cutting head includes three motors positioned within a cavity of the housing and oriented parallel to one another.

8. A cutting assembly for a mining machine, the cutting assembly comprising:

a mount configured to move about a first pivot axis relative to a chassis of the mining machine;

a cutting head including, a housing, a drum rotatably coupled to the housing about a rotational axis, a plurality of cutting bits coupled to the drum, and at least one motor supported by the housing to drive the drum about the rotational axis; and a ranging arm coupled to the mount and supporting the cutting head for movement about the first pivot axis, the ranging arm moveable relative to the mount along a first translational axis, the first translational axis parallel to the first pivot axis, wherein the housing is moveable relative to the ranging arm about a second pivot axis, and wherein the second pivot axis is parallel to the first translational axis.

9. The cutting assembly of claim 8, wherein the ranging arm includes a plurality of hollow structural members.

10. The cutting assembly of claim 8, wherein the cutting head includes at least two motors supported by the housing.

11. The cutting assembly of claim 10, wherein the housing supports at least a two-stage planetary transmission between the at least two motors and the drum to drive the drum about the rotational axis.

12. The cutting assembly of claim 8, wherein the cutting head includes a single motor, wherein the housing supports at least a four-stage planetary transmission between the single motor and the drum to drive the drum about the rotational axis.

13. The cutting assembly of claim 8, wherein the cutting head includes three motors positioned within a cavity of the housing and oriented parallel to one another.

14. A cutting assembly for a mining machine, the cutting assembly comprising:

a ranging arm configured to be coupled to a chassis of the mining machine;

a cutting head including, a housing coupled to the ranging arm, a drum rotatably coupled to the housing about a rotational axis, a plurality of cutting bits coupled to the drum, and at least one motor supported by the housing to drive the drum about the rotational axis; and a mount coupled to the ranging arm, the mount configured to move about a first pivot axis relative to the chassis of the mining machine, the mount enabling movement of the drum about the first pivot axis, wherein the drum is moveable along a first translational axis relative to the mount, wherein the first translational axis is defined between the ranging arm and the mount, wherein the drum is moveable along a second translational axis relative to the mount, wherein the second translational axis is defined between the ranging arm and the housing, wherein the cutting assembly is configured to include at least four degrees of movement of the drum relative to the chassis.

15. The cutting assembly of claim 14, wherein the ranging arm includes a plurality of hollow structural members.

16. The cutting assembly of claim 14, wherein the cutting head includes at least two motors supported by the housing.

17. The cutting assembly of claim 14, wherein the cutting head includes three motors positioned within a cavity of the housing and oriented parallel to one another.

18. The cutting assembly of claim 17, wherein the housing supports at least a two-stage planetary transmission between the at least two motors and the drum to drive the drum about the rotational axis.

19. The cutting assembly of claim 14, wherein the cutting head includes a single motor, wherein the housing supports at least a four-stage planetary transmission between the single motor and the drum to drive the drum about the rotational axis.

* * * * *